US006296677B1

(12) United States Patent
Ribeaud et al.

(10) Patent No.: US 6,296,677 B1
(45) Date of Patent: Oct. 2, 2001

(54) LIQUID POLYFUNCTIONAL ADDITIVES FOR IMPROVED FUEL LUBRICITY

(75) Inventors: Marc Ribeaud, Delémont; Paul Dubs, Fribourg; Michael Rasberger, Riehen; Samuel Evans, Marly, all of (CH)

(73) Assignee: Ciba Specialty Chemicals Corporation, Tarrytown, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/017,090

(22) Filed: Feb. 2, 1998

(30) Foreign Application Priority Data

Feb. 3, 1997 (EP) ..... 97810052

(51) Int. Cl.[7] ..... C10L 1/18

(52) U.S. Cl. ..... 44/308; 44/329; 44/330; 44/333; 44/334; 44/340; 44/341; 44/386

(58) Field of Search ..... 44/308, 329, 330, 44/333, 334, 340, 341, 386

(56) References Cited

U.S. PATENT DOCUMENTS 3,944,594 3/1976 Kleiner et al. ..... 260/473 S
5,668,206 * 9/1997 Dubs ..... 524/291

FOREIGN PATENT DOCUMENTS 1103144 2/1968 (GB) .
2325239 11/1998 (GB) .

* cited by examiner

*Primary Examiner*—Margaret Medley
*Assistant Examiner*—Cephia D. Toomer

(74) *Attorney, Agent, or Firm*—Kevin T. Mansfield

(57) ABSTRACT

The lubricity (anti-wear properties) of fuels, for example hydrocarbon fuels, oxygenated fuels or mixtures thereof, particularly diesel or aviation fuels having reduced sulphur and/or aromatic content for compliance with regulator requirements, is improved by addition of at least a product which can be obtained by reacting components a), b) and c), where component a) is a compound of the formula I or a mixture of compounds of the formula I, component b) is a compound of the formula II or a mixture of compounds of the formula II and component c) is a compound of the formula III or a mixture of compounds of the formula III, (I)

$$X(Y)_a,$$

(II)

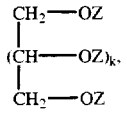

(III)

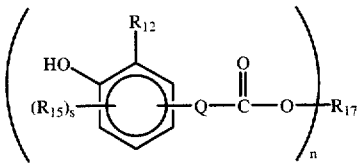

in which the general symbols are as defined in claim 1, the compound of the formula I being, for example, pentaerythritol, thiodiethylene glycol, 1,4-butanediol, 1,4-propanediol, diethylene glycol, triethylene glycol, diethanolamine or glycerol, the compound of the formula II being, for example, sunflower oil or coconut fat, and the compound of the formula III being, for example, methyl 3-(3',5'-di-tert-butyl-4'-hydroxyphenyl)propionate. The abovementioned products also improve corrosion inhibition.

13 Claims, No Drawings

LIQUID POLYFUNCTIONAL ADDITIVES FOR IMPROVED FUEL LUBRICITY

The present invention relates to anti-wear fuel compositions comprising a fuel, preferably a diesel and other fuels having lower sulfur and/or aromatic contents and a liquid polyfunctional additive, and to the use of the liquid polyfunctional additive as anti-wear agent and lubricity improver for an engine fuel system.

The United States Government has mandated a reduction in the sulfur and aromatic content of commercial diesel fuels. Regulatory agencies in other countries have either introduced such a requirement or are contemplating doing so. This regulatory regime causes a problem insofar as the fuel industry recognises that fuels which comply with the regulation will exhibit reduced lubricity. The refining processes needed to produce these fuels require more severe hydrotreatment which removes polar species from the fuel and reduces its lubricity. Lubricity is a measure of the capacity of the fuel to flow through the engine without causing excessive wear. Even marginal changes in lubricity may be significant in increasing wear of fuel pumps, valves and injector nozzles over an extended period of use.

WO 96/16143 discloses that specific phosphorus esters improve the lubricity (anti-wear properties) of hydrocarbon fuels, oxygenate fuels or mixtures thereof, particularly diesel or aviation fuels having reduced sulfur and/or aromatic content.

EP-A-0 565 487 which is related to U.S. Pat. No. 5,478,875 discloses liquid antioxidants as stabilizers for polymers and lubricants.

Surprisingly, it has now been found that these liquid antioxidants possess also anti-wear, lubricity improving and corrosion inhibiting properties in fuels having lower sulfur and/or aromatic contents.

Accordingly, the present invention relates to an anti-wear fuel composition comprising α) a fuel and β) at least a product obtainable by reacting components a), b) and c), where component a) is a compound of the formula I or a mixture of compounds of the formula I, component b) is a compound of the formula II or a mixture of compounds of the formula II and component c) is a compound of the formula III or a mixture of compounds of the formula III, (I)

$$X(Y)_a,$$

(II)

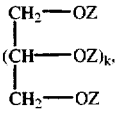

(III)

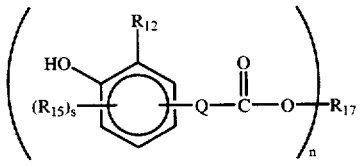

in which, in the compound of the formula I, the radicals Y independently of one another are OH, $(HOCH_2CH_2)_2N$— or —$HNR_1$ and

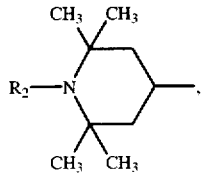

the radicals $R_1$ are hydrogen, $C_1$–$C_{18}$alkyl, $C_5$–$C_{12}$cycloalkyl, $C_3$–$C_6$alkenyl, $C_7$–$C_9$phenylalkyl, phenyl, or phenyl which is substituted by 1 to 3 radicals $A_1$, the radicals $A_1$ independently of one another being $C_1$–$C_{12}$alkyl, halogen, hydroxyl, methoxy or ethoxy, in which $R_2$ is hydrogen, $C_1$–$C_8$alkyl, $O^{19}$, OH, NO, —$CH_2CN$, $C_1$–$C_{18}$alkoxy, $C_5$–$C_{12}$cycloalkoxy, $C_3$–$C_6$alkenyl, $C_7$–$C_9$phenylalkyl or $C_7$–$C_9$phenylalkyl which is mono-, di- or trisubstituted on the phenyl ring by $C_1$–$C_4$alkyl, or $R_2$ is furthermore $C_1$–$C_8$acyl or $HOCH_2CH_2$—, and a is the number 1, 2, 3, 4 or 6, where, if Y is OH and a is 1, X is $C_1$–$C_{45}$alkyl, $C_3$–$C_{18}$alkenyl, —$CH_2CH_2T_1(CH_2CH_2O)_bR_4$ or

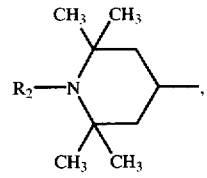

in which $R_2$ is as defined above, and $T_1$ is oxygen, sulfur or

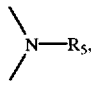

$R_4$ is $C_1$–$C_{20}$alkyl, b is an integer ranging from 0 to 10 and $R_5$ is hydrogen, $C_1$–$C_{18}$alkyl or phenyl, or, if Y is OH and a is 2, X is —$CH_2CH_2T_2(CH_2CH_2O)_bCH_2CH_2$—, in which b is as defined above,

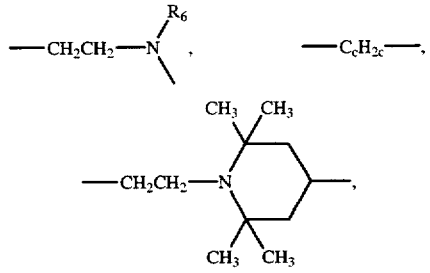

-continued

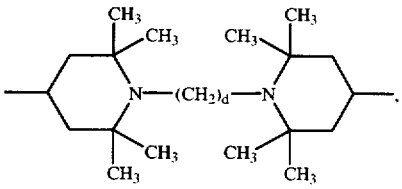

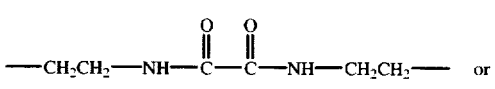

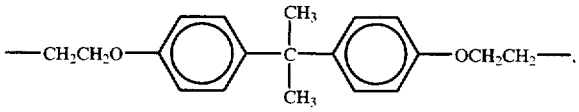

in which $T_2$ is oxygen, sulfur,

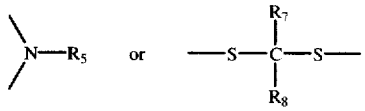

and $R_5$ is as defined above, $R_6$ is hydrogen, $C_1$–$C_{18}$alkyl or phenyl, c is an integer ranging from 2 to 10, d is an integer ranging from 2 to 6 and $R_7$ and $R_8$ independently of one another are hydrogen, $C_1$–$C_{18}$alkyl or phenyl, or $R_7$ and $R_8$ together with the C atom to which they are bonded form a $C_5$–$C_{12}$cycloalkyl ring, or if a is 3, X is $C_3$–$C_{10}$alkanetriyl or $N(CH_2CH_2—)_3$, or, if Y is OH and a is 4, X is $C_4$–$C_{10}$alkanetetray,

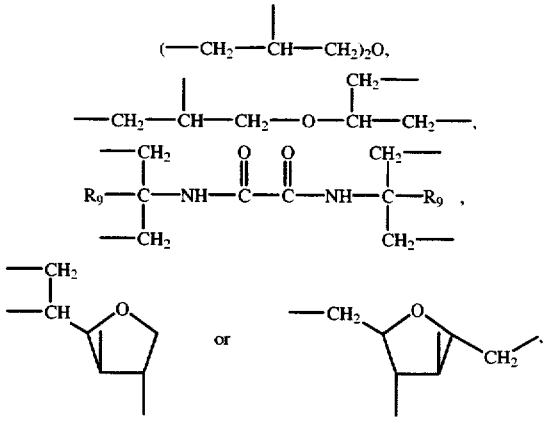

in which $R_9$ is $C_1$–$C_4$alkyl, or, if Y is OH and a is 6,

X is

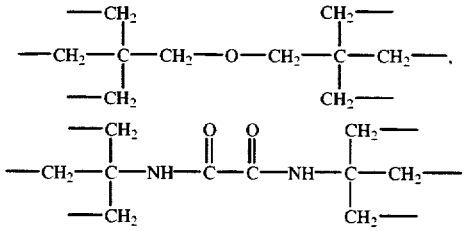

or $C_6$–$C_{10}$alkanehexayl, or, if Y is $HNR_1$ and a is 1,

X is $C_1$–$C_{18}$alkyl, $C_3$–$C_{18}$alkenyl, $C_5$–$C_{12}$cycloalkyl, $C_7$–$C_9$phenylalkyl, phenyl,

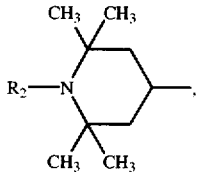

in which $R_2$ is as defined above or X is furthermore

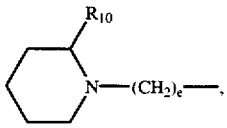

or X together with $R_1$ is a group of the formula —$CH_2CH_2CH_2CH_2CH_2$— or —$CH_2CH_2OCH_2CH_2$—, in which $R_{10}$ is hydrogen or methyl and e is 2 or 3, or, if Y is —$HNR_1$ and a is 2, X is —$C_fH_{2f}$—,

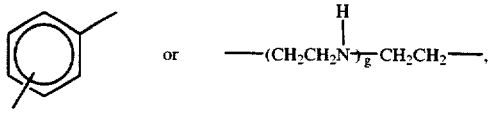

in which f is an integer ranging from 2 to 10 and g is an integer ranging from 1 to 6, and, in the compound of the formula II, the radicals Z are hydrogen or a group of the formula

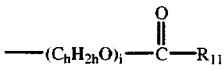

and k is an integer ranging from 0 to 6, in which h is 2 or 3, i is an integer ranging from 0 to 12 and $R_{11}$ is $C_1$–$C_{30}$alkyl, $C_8$–$C_{30}$alkenyl, $C_5$–$C_{12}$cycloalkyl, phenyl or $C_7$–$C_9$phenylalkyl, with the proviso that the compound of the formula II has a group

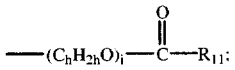

in the compound of the formula III, $R_{12}$ is $C_1$–$C_{18}$alkyl, $C_5$–$C_{12}$cycloalkyl, phenyl or $C_7$–$C_9$phenylalkyl, $R_{15}$ is hydrogen, $C_1$–$C_{18}$alkyl, $C_5$–$C_{12}$cycloalkyl, phenyl or $C_7$–$C_9$phenylalkyl, s is 0, 1 or 2, Q is $—C_mH_{2m}—$,

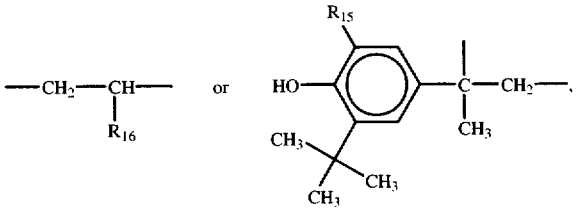

in which $R_{15}$ is as defined above, m is an integer ranging from 0 to 3, $R_{16}$ is $C_1$–$C_8$alkyl and n is an integer ranging from 1 to 6, where, if n is 1, $R_{17}$ is hydrogen, $C_1$–$C_{45}$alkyl, $C_5$–$C_{12}$cycloalkyl, $C_2$–$C_{18}$alkenyl, a monovalent radical of a hexose, a monovalent radical of a hexitol,

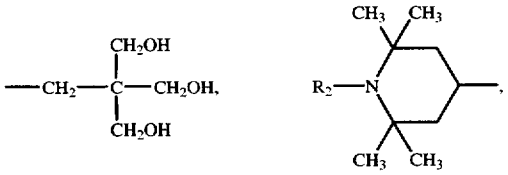

in which $R_2$ is as defined above, or furthermore $R_{17}$ is $—CH_2CH_2—T_3—R_{19}$ or in which $T_3$ is oxygen, sulfur or

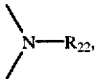

$R_{19}$ is

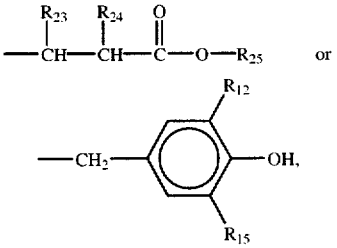

in which $R_{12}$ and $R_{15}$ are as defined above, or $R_{19}$ is furthermore hydrogen, $C_1$–$C_{24}$alkyl, phenyl, $C_5$–$C_{12}$cycloalkyl or

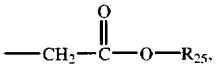

in which p is an integer ranging from 2 to 4, q is an integer ranging from 2 to 20, $R_{22}$ is $C_1$–$C_{18}$alkyl, phenyl or phenyl which is substituted by 1 to 3 radicals $A_1$, in which the radicals $A_1$ independently of one another are $C_1$–$C_{12}$alkyl, halogen, hydroxyl, methoxy or ethoxy, or $R_{22}$ is furthermore $C_5$–$C_8$cycloalkyl, $R_{23}$ and $R_{24}$ independently of one another are hydrogen or methyl, with the proviso that $R_{23}$ and $R_{24}$ are not simultaneously methyl;

$R_{25}$ is hydrogen or $C_1$–$C_{24}$alkyl, or, if n is 2, $R_{17}$ is a divalent radical of a hexose, a divalent radical of a hexitol,

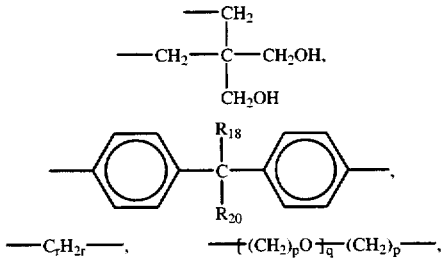

in which p and q are as defined above, $—CH_2CH_2—T_4—CH_2CH_2—$, $—CH_2—CH=CH—CH_2—$, $—CH_2—C≡C—CH_2—$,

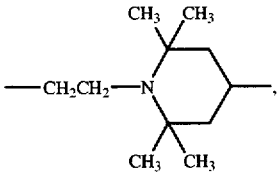

-continued

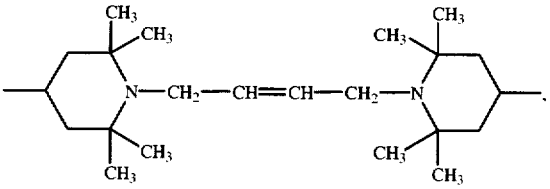

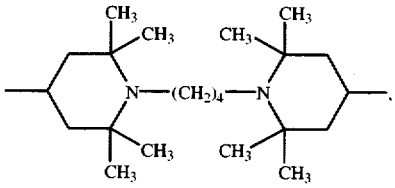

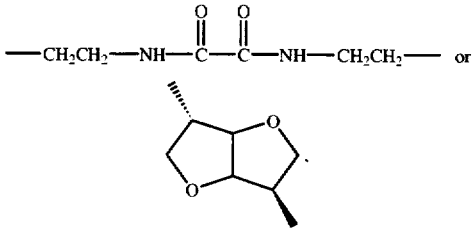

in which $R_{18}$ and $R_{20}$ independently of one another are hydrogen or $C_1$–$C_{12}$alkyl or together are the radical —$CH_2CH_2CH_2CH_2CH_2$—, r is an integer ranging from 2 to 10, $T_4$ is sulfur,

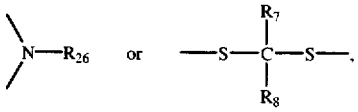

in which $R_7$ and $R_8$ are as defined above, and $R_{26}$ is hydrogen, $C_1$–$C_{18}$alkyl, phenyl or phenyl which is substituted by 1 to 3 radicals $A_1$, in which the radicals $A_1$ are as defined above in formula I, or $R_{26}$ is furthermore $C_5$–$C_8$cycloalkyl or

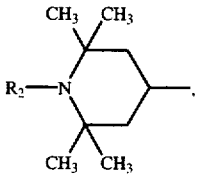

in which $R_2$ is as defined above, or, if n is 3, $R_{17}$ is a trivalent radical of a hexose, a trivalent radical of a hexitol,

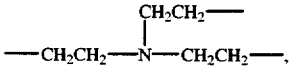

-continued

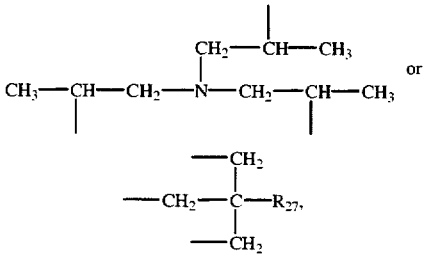

in which $R_{27}$ is hydrogen, $CH_2OH$, $C_1$–$C_4$alkyl, $C_1$–$C_{18}$alkylamido or

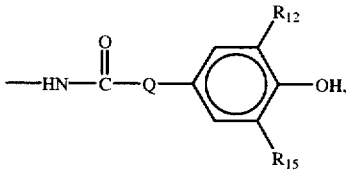

in which Q, $R_{12}$ and $R_{15}$ are as defined above, or, if n is 4, $R_{17}$ is a tetravalent radical of a hexose, a tetravalent radical of a hexitol, $C_4$–$C_{10}$alkanetetrayl,

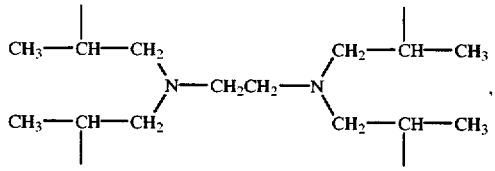

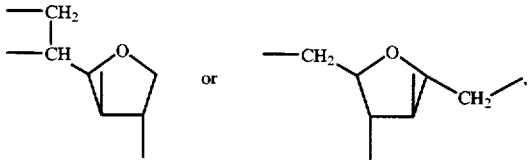

or, if n is 5, $R_{17}$ is a pentavalent radical of a hexose or a pentavalent radical of a hexitol, or, if n is 6, $R_{17}$ is a hexavalent radical of a hexitol or

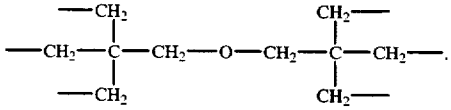

Alkyl having not more than 45 C atoms is a branched or unbranched radical such as, for example, methyl, ethyl, propyl, isopropyl, n-butyl, sec-butyl, isobutyl, tert-butyl, 2-ethyl-butyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, 2-ethylhexyl, 1,1,3-trimethylhexyl, 1,1,3,3-tetramethylpentyl, nonyl, decyl, undecyl, 1-methylundecyl, dodecyl, 1,1,3,3,5,5-hexamethylhexyl, tridecyl, tetradecyl, pentadecyl, hexadecyl, heptadecyl, octadecyl, eicosyl, docosyl or pentacosyl. One of the preferred meanings of $R_1$, $R_4$ and $R_{16}$ is, for example, $C_1$–$C_4$alkyl, of $R_2$ methyl, of $R_{11}$ $C_1$–$C_{20}$alkyl, of $R_{12}$ and $R_{15}$ $C_1$–$C_4$alkyl, in particular tert-butyl, and of $R_{17}$ $C_1$–$C_{18}$alkyl.

Cycloalkyl having not more than 12 C atoms is, for example, cyclopentyl, cyclohexyl, cycloheptyl, cyclooctyl, cyclodecyl or cyclododecyl. One of the preferred meanings of $R_1$, $R_{11}$, $R_{12}$ and $R_{15}$ is $C_5$–$C_7$cycloalkyl. Cyclohexyl is particularly preferred.

Alkenyl having not more than 30 C atoms is, for example, vinyl, propenyl, isopropenyl, 2-butenyl, 3-butenyl, isobutenyl, n-penta-2,4-dienyl, 3-methylbut-2-enyl, n-oct-2-enyl, n-dodec-2-enyl, iso-dodecenyl, oleyl, n-octadec-2-enyl or n-octadec-4-enyl. If $R_1$, $R_2$ and X are $C_3$–$C_6$alkenyl, then the C atom which is bonded to the nitrogen is advantageously saturated.

Phenylalkyl having 7 to 9 C atoms is, for example, benzyl, α-methylbenzyl, α,α-dimethylbenzyl or phenylethyl. Benzyl is preferred.

Examples of phenyl which is substituted by 1 to 3 radicals $A_1$ are o-, m- or p-methylphenyl, 2,3-dimethylphenyl, 2,4-dimethylphenyl, 2,5-dimethylphenyl, 2,6-dimethylphenyl, 3,4-dimethylphenyl, 3,5-dimethylphenyl, 2-methyl-6-ethylphenyl, 2-methyl-4-tert-butylphenyl, 2-ethylphenyl, 2,6-diethylphenyl, 2,6-diethyl-4-methylphenyl, 2,6-diisopropylphenyl, 4-tert-butylphenyl, p-nonylphenyl, o-, m- or p-chlorophenyl, 2,3-dichlorophenyl, 2,4-dichlorophenyl, 2,5-dichlorophenyl, 2,6-dichlorophenyl, 3,4-dichlorophenyl, 2,4,5-trichlorophenyl, 2,4,6-trichlorophenyl, o-, m- or p-hydroxyphenyl, o-, m- or p-methoxyphenyl, o- or p-ethoxyphenyl, 2,4-dimethoxyphenyl, 2,5-dimethoxyphenyl, 2,5-diethoxyphenyl, o-, m- or p-methoxycarbonyl, 2-chloro-6-methylphenyl, 3-chloro-2-methylphenyl, 3-chloro-4-methylphenyl, 4chloro-2-methylphenyl, 5-chloro-2-methylphenyl, 2,6-dichloro-3-methylphenyl, 2-hydroxy-4-methylphenyl, 3-hydroxy-4-methylphenyl, 2-methoxy-5-methylphenyl, 4-methoxy-2-methylphenyl, 3-chloro-4-methoxyphenyl, 3-chloro-6-methoxyphenyl, 3-chloro-4,6-dimethoxyphenyl and 4-chloro-2,5-dimethoxyphenyl. Preferred is phenyl which is substituted by 1 or 2, in particular 1, radical(s) $A_1$, $A_1$ being, in particular, alkyl.

Alkyl having 1 to 18 C atoms is, for example, methoxy, ethoxy, propoxy, isopropoxy, n-butoxy, isobutoxy, pentoxy, isopentoxy, hexoxy, heptoxy, octoxy, decyloxy, tetradecyloxy, hexadecyloxy or octadecyloxy. One of the preferred meanings of $R_2$ is $C_6$–$C_{12}$alkoxy. Heptoxy and octoxy are particularly preferred.

Cycloalkoxy having 5 to 12 C atoms is, for example, cyclopentoxy, cyclohexoxy, cycloheptoxy, cyclooctoxy, cyclodecyloxy or cyclododecyloxy. One of the preferred meanings of $R_2$ is $C_5$–$C_8$cycloalkoxy. Cyclopentoxy and cyclohexoxy are particularly preferred.

Examples of $C_7$–$C_9$phenylalkyl which is mono-, di- or trisubstituted on the phenyl ring by $C_1$–$C_4$alkyl are methylbenzyl, dimethylbenzyl, trimethylbenzyl or tert-butylbenzyl.

Acyl having 1 to 8 C atoms is, for example, Formyl, Acetyl, Propionyl, Butyryl, Pentanoyl, Hexanoyl, Heptanoyl, Octanoyl, Benzoyl, Acryloyl or Crotonyl. $C_1$–$C_8$Alkanoyl, $C_3$–$C_8$alkenoyl or benzoyl, in particular acetyl, are preferred.

Alkanetriyl having 3 to 10 C atoms is, for example,

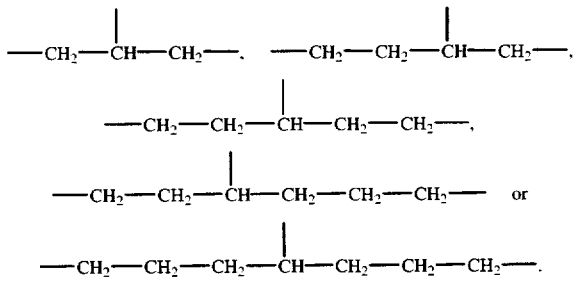

Glyceryl is preferred.

Alkanetetrayl having 4 to 10 C atoms is, for example,

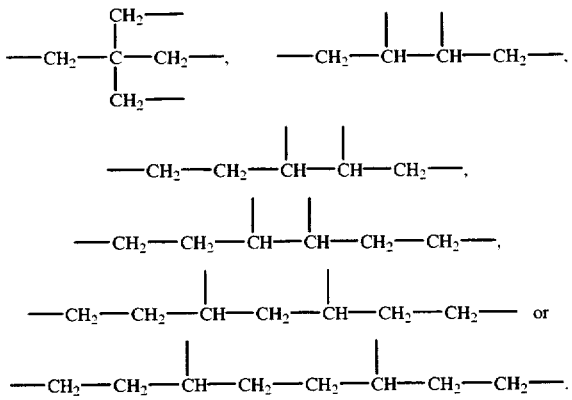

Pentaerythrityl is preferred.

Alkanehexayl having 6 to 10 C atoms is, for example,

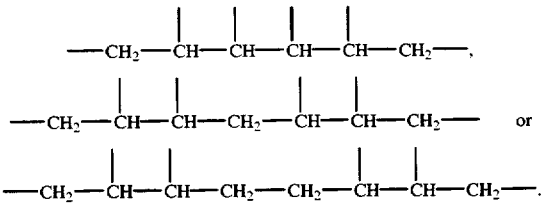

If $R_{17}$ with n=1 to 6 is an n-valent radical of a hexose, then this radical is derived, for example, from allose, altrose, glucose, mannose, gulose, idose, galactose or talose, i.e. to obtain the corresponding compounds of the formula III, one, two, three, four, five or six —OH groups must be replaced by the ester group E-1, (E-1)

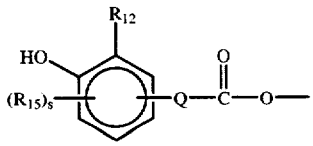

in which $R_{12}$, $R_{15}$, s and Q are as defined above. For example, $R_{17}$ with n=5 can be a group

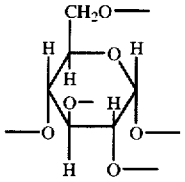

If $R_{17}$ is the n-valent radical of a hexitol, then the corresponding compounds of the formula III are obtained by replacing n —OH groups by the abovementioned ester group E-1. $R_{17}$ as a hexavalent radical of a hexitol can be, for example,

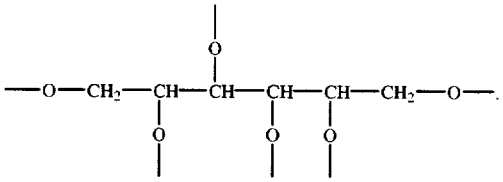

This group is derived from D-sorbitol.

Alkylamido having 1 to 18 C atoms is, for example, $CH_3$—CO—NH—, $CH_3CH_2$—CO—NH—, $C_6H_{13}$—CO—NH— or $C_{18}H_{37}$—CO—NH—.

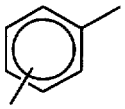

means that the phenyl ring can be ortho-, meta- or para-substituted.

The three components a), b) and c) can be reacted with each other to give the products of the present invention in any desired sequence.

Preferably, component a) is first reacted with component b), and component c) is then added.

The reaction is advantageously carried out in the presence of a catalyst. Suitable catalysts are Lewis acids or bases.

Examples of suitable basic catalysts are metal hydrides, metal alkylides, metal arylides, metal hydroxides, metal alcoholates, metal phenolates, metal amides or metal carboxylates.

Examples of preferred metal hydrides are lithium hydride, sodium hydride or potassium hydride.

Examples of preferred metal alkylides are butyllithium or methyllithium.

An example of a preferred metal arylide is phenyllithium.

Examples of preferred metal hydroxides are lithium hydroxide, sodium hydroxide, potassium hydroxide, caesium hydroxide, rubidium hydroxide, magnesium hydroxide, calcium hydroxide, barium hydroxide or aluminium hydroxide.

Examples of preferred metal alcoholates are sodium methanolate, sodium ethanolate, potassium methanolate, potassium ethanolate, sodium isopropylate or potassium tert-butylate.

Examples of preferred metal phenolates are sodium phenolate or potassium phenolate.

Examples of preferred metal amides are sodium amide or lithium amide.

An example of a preferred metal carboxylate is calcium acetate.

Examples of suitable Lewis acid catalysts are

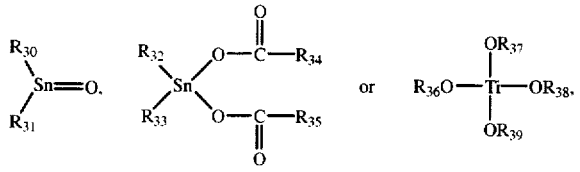

the radicals $R_{30}$, $R_{31}$, $R_{32}$, $R_{33}$, $R_{34}$, $R_{35}$, $R_{36}$, $R_{37}$, $R_{38}$ and $R_{39}$ being, independently of one another, for example $C_1$–$C_{18}$alkyl or phenyl. $C_1$–$C_8$Alkyl is preferred. A particularly preferred Lewis acid catalyst is dibutyltin oxide.

The catalyst is added to components a), b) and c) for example in an amount of from 0.05 to 10 per mil by weight, preferably in an amount of from 0.1 to 5 per mil by weight. An addition of 1 to 2 per mil by weight of dibutyltin oxide is particularly preferred.

The components a), b) and c) can be reacted in a solvent, for example xylene, or without solvent. The reaction is preferably carried out without solvent.

The reaction temperature is, for example, between 130 and 250° C. The reaction is preferably carried out in a temperature range from 130 to 190° C.

A preferred process for the preparation of the products of component (β) comprises reacting the components a), b) and c) in a molar quantitative ratio of 0.1:1:0.1 to 15:1:30 and is disclosed in EP-A-0 565 487 which is related to U.S. Pat. No. 5,478,875.

If components a), b) and c) are not commercially available, they can be prepared by known processes or analogously. Possible preparation processes for the compounds of the formula III can be found, for example, in the following publications: GB-A-996 502, U.S. Pat. Nos. 3,330,859; 3,944,594; 4,593,057; EP-A-154 518 or U.S. Pat. No. 3,960,928.

Of interest are compositions comprising as component (β) products where, in the compound of the formula III, s is the number 1 or 2.

Of specific interest are compositions comprising as component (β) products in which, in the compound of the formula I, the radicals Y independently of one another are OH, $(HOCH_2CH_2)_2N$— or —$HNR_1$ and $R_1$ is hydrogen, $C_1$–$C_{10}$alkyl, $C_5$–$C_7$cycloalkyl,

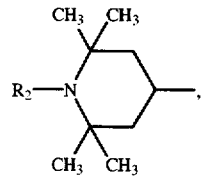

$C_3$–$C_6$alkenyl, benzyl or phenyl, in which $R_2$ is hydrogen, $C_1$–$C_4$alkyl, OH, $CH_2CN$, $C_6$–$C_{12}$alkoxy, $C_5$–$C_8$cycloalkoxy, allyl, benzyl, acetyl or $HOCH_2CH_2$— and a is the number 1, 2, 3, 4 or 6, where, if Y is OH and a is 1, X is $C_1$–$C_{30}$alkyl, $C_3$–$C_{18}$alkenyl, —$CH_2CH_2T_1$ $(CH_2CH_2O)_bR_4$ or

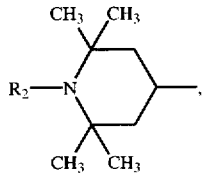

in which $R_2$ is as defined above, and $T_1$ is oxygen, sulfur or

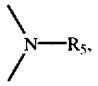

$R_4$ is $C_1$–$C_{10}$alkyl, b is an integer ranging from 0 to 10 and $R_5$ is hydrogen, $C_1$–$C_{10}$alkyl or phenyl, or, if Y is OH and a is 2, X is $—CH_2CH_2T_2(CH_2CH_2O)_bCH_2CH_2—$, in which b is as defined above,

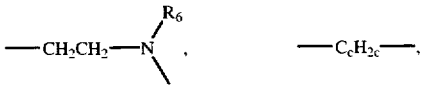

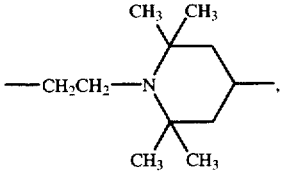

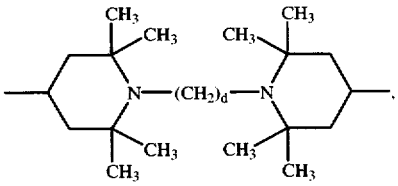

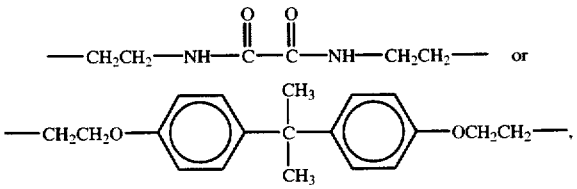

in which $T_2$ is oxygen, sulfur,

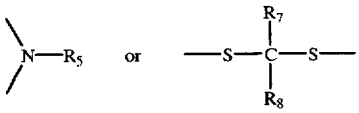

and $R_5$ is as defined above, $R_6$ is hydrogen, $C_1$–$C_{10}$alkyl or phenyl, c is an integer ranging from 2 to 10, d is an integer ranging from 2 to 6 and $R_7$ and $R_8$ independently of one another are hydrogen, $C_1$–$C_{10}$alkyl or phenyl, or $R_7$ and $R_8$ together with the C atom to which they are bonded form a $C_5$–$C_7$cycloalkyl ring, or, if Y is $—HNR_1$ and a is 1, X is $C_1$–$C_{10}$alkyl, $C_3$–$C_{18}$alkenyl, $C_5$–$C_7$cycloalkyl, benzyl, phenyl,

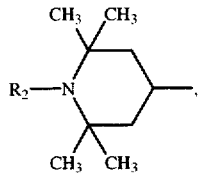

in which $R_2$ is as defined above, or X is furthermore

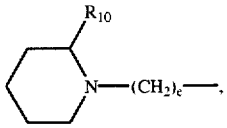

or X together with $R_1$ is a group of the formula $—CH_2CH_2CH_2CH_2CH_2—$ or $—CH_2CH_2OCH_2CH_2—$, in which $R_{10}$ is hydrogen or methyl and e is 2 or 3, and in the compound of the formula II, the radicals Z are hydrogen or a group of the formula

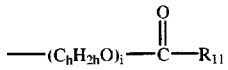

and k is an integer ranging from 0 to 4, in which h is 2 or 3, i is an integer ranging from 0 to 6 and $R_{11}$ is $C_1$–$C_{20}$alkyl, $C_8$–$C_{20}$alkenyl, $C_5$–$C_7$cycloalkyl, phenyl or benzyl, with the proviso that the compound of the formula II comprises a group

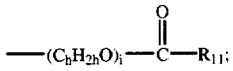

in the compound of the formula III $R_{12}$ is $C_1$–$C_6$alkyl, $C_5$–$C_7$cycloalkyl, phenyl or benzyl $R_{15}$ is hydrogen, $C_1$–$C_6$alkyl, $C_5$–$C_7$cycloalkyl, phenyl or benzyl, s is 1 or 2, Q is $—C_mH_{2m}—$,

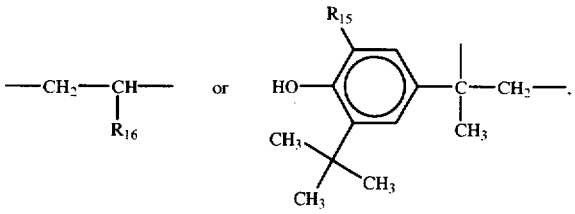

in which $R_{15}$ is as defined above, m is an integer ranging from 0 to 3, $R_{16}$ is $C_1$–$C_4$alkyl and n is an integer ranging from 1 to 6, where, if n is 1, $R_{17}$ is hydrogen, $C_1$–$C_{30}$alkyl, $C_5$–$C_7$cycloalkyl, $C_2$–$C_{18}$alkenyl, a monovalent radical of a hexose, a monovalent radical of a hexitol,

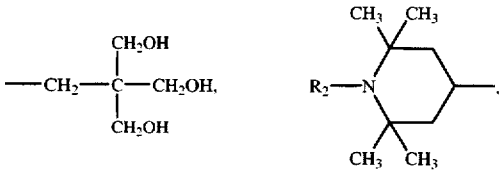

in which $R_2$ is as defined above, or furthermore $R_{17}$ is $—CH_2CH_2—T_3—R_{19}$ or

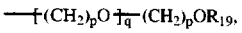

in which $T_3$ is oxygen, sulfur or

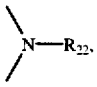

$R_{19}$ is

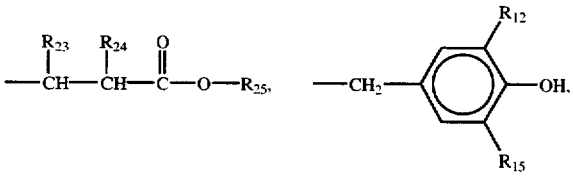

in which $R_{12}$ and $R_{15}$ are as defined above, or $R_{19}$ is furthermore hydrogen, $C_1$–$C_{18}$, phenyl, $C_5$–$C_7$cycloalkyl or

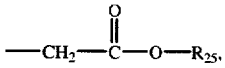

in which p is an integer ranging from 2 to 4, q is an integer ranging from 2 to 20, $R_{22}$ is $C_1$–$C_{10}$alkyl, phenyl or $C_5$–$C_8$cycloalkyl, $R_{23}$ and $R_{24}$ independently of one another are hydrogen or methyl with the proviso that $R_{23}$ and $R_{24}$ are not simultaneously methyl;

$R_{25}$ is hydrogen or $C_1$–$C_{18}$alkyl, or, if n is 2, $R_{17}$ is a divalent radical of a hexose, a divalent radical of a hexitol,

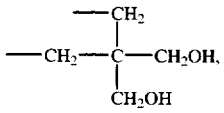

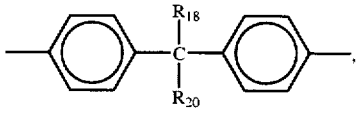

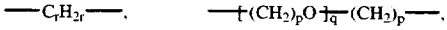

in which p and q are as defined above, $—CH_2CH_2—T_4—CH_2CH_2—$, $—CH_2—CH=CH—CH_2—$, $—CH_2—C≡C—CH_2—$,

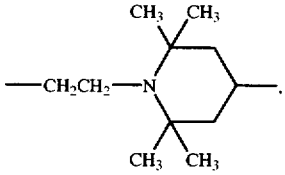

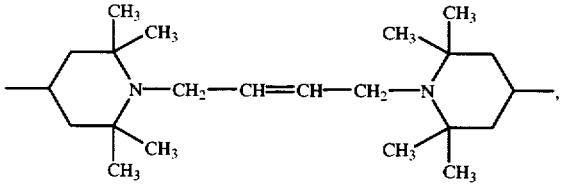

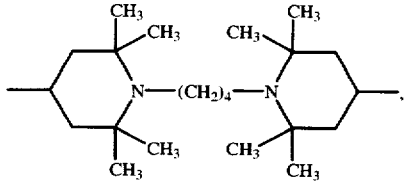

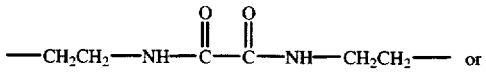

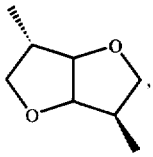

in which $R_{18}$ and $R_{20}$ independently of one another are hydrogen or $C_1$–$C_6$alkyl or together are the radical $—CH_2CH_2CH_2CH_2CH_2—$, r is an integer ranging from 2 to 10, $T_4$ is sulfur,

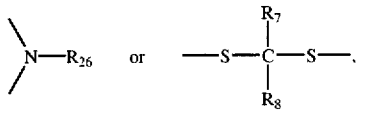

in which $R_7$ and $R_8$ are as defined above and $R_{26}$ is hydrogen, $C_1$–$C_{10}$alkyl, phenyl, $C_5$–$C_8$cycloalkyl or

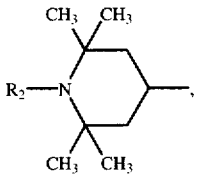

in which $R_2$ is as defined above.

Preference is given to compositions comprising as component (β) products in which, in the compound of the formula I, the radicals Y independently of one another are OH, $(HOCH_2CH_2)_2N$— or —$HNR_1$ and $R_1$ is hydrogen, $C_1$–$C_4$alkyl or

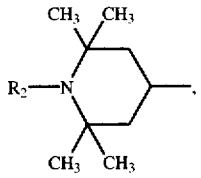

in which $R_2$ is hydrogen, $C_1$–$C_4$alkyl, OH, allyl, benzyl, acetyl or $HOCH_2CH_2$— and a is the number 1, 2, 3, 4 or 6, where if Y is OH and a is 1, X is $C_1$–$C_{18}$alkyl, $C_3$–$C_{18}$alkenyl, —$CH_2CH_2T_1(CH_2CH_2O)_bR_4$ or

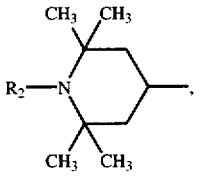

in which $R_2$ is as defined above, and $T_1$ is oxygen, $R_4$ is $C_1$–$C_4$alkyl and b is an integer ranging from 0 to 10, or if Y is OH and a is 2, X is —$CH_2CH_2T_2(CH_2CH_2O)_bCH_2CH_2$—, in which b is as defined above, or furthermore X is —$C_cH_{2c}$—,

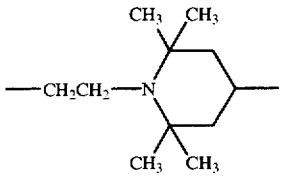

or —$CH_2$—CH=CH—$CH_2$—, in which $T_2$ is oxygen, sulfur or

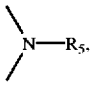

$R_5$ is hydrogen, b is the number 0 or 1 and c is an integer ranging from 2 to 8, or, if a is 3, X is

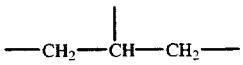

or $N(CH_2CH_2—)_3$, or, if Y is OH and a is 4,

X is

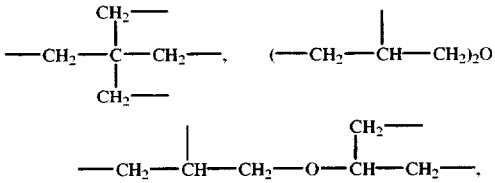

or if Y is OH and a is 6,

X is

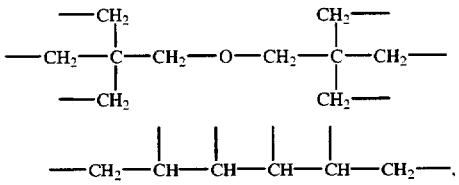

or, if Y is —$HNR_1$ and a is 1,

X is $C_1$–$C_{10}$alkyl, $C_3$–$C_{18}$alkenyl, $C_5$–$C_7$cycloalkyl or

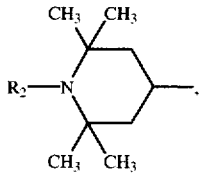

where $R_2$ is as defined above, or, if Y is —$HNR_1$ and a is 2,

X is —$C_fH_{2f}$— in which f is an integer ranging from 2 to 10 and, in the compound of the formula II, the radicals Z are hydrogen or a group of the formula

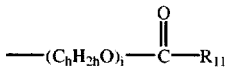

and k is 1, 2 or 3, h is 2 or 3, i is an integer ranging from 0 to 4 and $R_{11}$ is $C_1$–$C_{20}$alkyl or $C_8$–$C_{20}$alkenyl, with the proviso that the compound of the formula II comprises a group

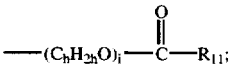

in the compound of the formula III, $R_{12}$ is $C_1$–$C_6$alkyl or $C_5$–$C_7$cycloalkyl, $R_{15}$ is hydrogen, $C_1$–$C_6$alkyl or $C_5$–$C_7$cycloalkyl, s is 1 or 2, Q is —$C_mH_{2m}$— or

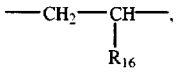

m is an integer ranging from 0 to 3, $R_{16}$ is $C_1$–$C_4$alkyl and n is an integer ranging from 1 to 6, where, if n is 1, $R_{17}$ is hydrogen, $C_1$–$C_{18}$alkyl, $C_5$–$C_7$cycloalkyl, $C_2$–$C_{18}$alkenyl, a monovalent radical of a hexose, a monovalent radical of a hexitol,

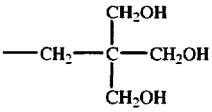

or

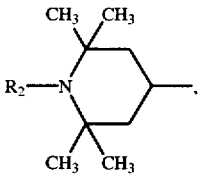

in which $R_2$ is as defined above, or furthermore $R_{17}$ is

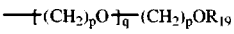

in which $R_{19}$ is hydrogen, $C_1$–$C_{18}$alkyl or $C_5$–$C_7$cycloalkyl, in which p is an integer ranging from 2 to 4, q is an integer ranging from 2 to 10, or, if n is 2, $R_{17}$ is a divalent radical of a hexose, a divalent radical of a hexitol,

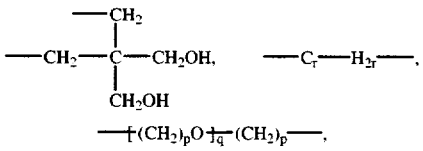

in which p and q are as defined above,

—$CH_2CH_2$—$T_4$—$CH_2CH_2$—, or

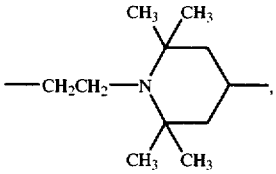

in which r is an integer ranging from 2 to 10, $T_4$ is sulfur or

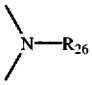

and $R_{26}$ is hydrogen, $C_1$–$C_{10}$alkyl or $C_5$–$C_8$cycloalkyl, or, if n is 3, $R_{17}$ is a trivalent radical of a hexose, a trivalent radical of a hexitol,

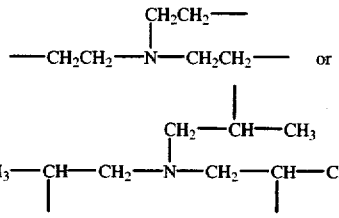

or, if n is 4, $R_{17}$ is a tetravalent radical of a hexose, a tetravalent radical of a hexitol,

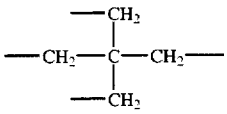

or

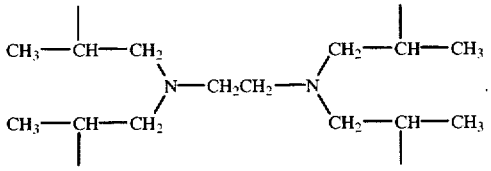

Preference is also given to compositions comprising as component (β) products in which, in the compound of the formula I, the radicals Y independently of one another are hydroxyl or —$NH_2$ and a is an integer ranging from 1 to 4, where, if a is 1, X is

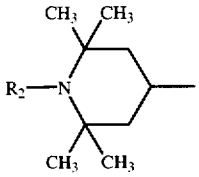

and $R_2$ is hydrogen, methyl or $HOCH_2CH_2$—, or, if Y is OH and a is 2,

X is —$CH_2CH_2T_2(CH_2CH_2O)_bCH_2CH_2$—, —$C_cH_{2c}$— or

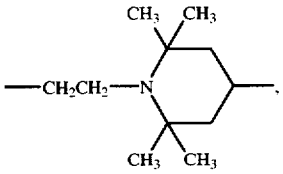

in which $T_2$ is oxygen, sulfur or

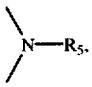

$R_5$ is hydrogen, b is the number 0 or 1 and c is the number 2, 3 or 4, or, if Y is OH and a is 3, X is

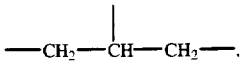

or, if Y is OH and a is 4,

X is

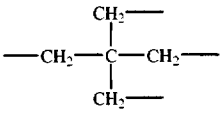

and in the compound of the formula II, the radicals Z are hydrogen or a group of the formula

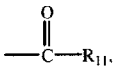

k is the number 1 and $R_{11}$ is $C_1$–$C_{20}$alkyl or $C_8$–$C_{20}$alkenyl, with the proviso that the compound of the formula II comprises a group

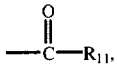

and, in the compound of the formula III, $R_{12}$ is tert-butyl, $R_{15}$ is $C_1$–$C_4$alkyl and is bonded in the ortho-position relative to the OH group, s is the number 1, Q is —$C_mH_{2m}$— and is bonded in the para-position relative to the OH group, where m is the number 2, n is 1 and $R_{17}$ is $C_1$–$C_4$alkyl.

Examples of preferred compounds of the formula I are pentaerythritol, thiodiethylene glycol, 1,4-butanediol, 1,2-propanediol, diethylene glycol, triethylene glycol, diethanolamine, glycerol,

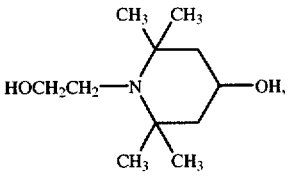

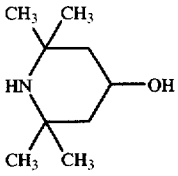

or

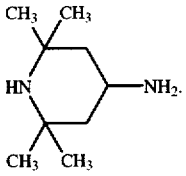

Glycerol or thiodiethylene glycol are particularly preferred.

Preferred compounds of the formula II are naturally occurring vegetable oils, fats and waxes, animal oils and fats as well as artificial polyol derivatives.

Preferred vegetable oils, fats and waxes are, for example, sunflower oil, coconut fat, rapeseed oil, soya oil, maize germ oil, safflower oil, olive oil, groundnut oil, cottonseed oil, sesame seed oil, castor oil, tallow oil, pumpkin seed oil or linseed oil.

Preferred animal oils and fats are, for example, butter fat, lard, fish oil, sperm oil, neat's foot oil or train oils.

Examples of preferred artificial polyol derivatives are Radiamuls (glycerol tri $C_8/C_{10}$) or sorbitan derivatives. The sorbitan derivatives are commercially available, for example, under the names Span®20, Span®40, Span®60, Span®65, Span®80, Span®85, Tween 20®, Tween 40®, Tween 60®, Tween 65®, Tween 80® or Tween 85®.

Sunflower oil, coconut fat or rapeseed oil are particularly preferred.

Of particular interest are compositions comprising as component (β) products in which, in the compound of the formula III, $R_{12}$ is $C_1$–$C_4$alkyl or cyclohexyl, $R_{15}$ is $C_1$–$C_4$alkyl or cyclohexyl and is bonded in the ortho-position relative to the OH group, s is the number 1, Q is $—C_mH_{2m}—$ and is bonded in the para-position relative to the OH group, where m is an integer ranging from 0 to 3 and n is an integer ranging from 1 to 4, where, if n is 1, $R_{17}$ is hydrogen, $C_1$–$C_{10}$alkyl, cyclohexyl, $C_2$–$C_{18}$alkenyl or

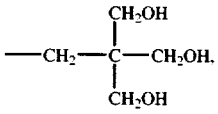

or, if n is 2, $R_{17}$ is

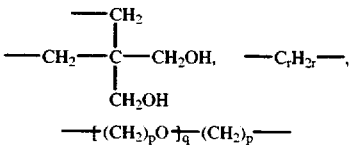

or $—CH_2CH_2—T_4—CH_2CH_2—$ in which p is an integer ranging from 2 to 4, q is an integer ranging from 2 to 10, r is an integer ranging from 2 to 6, $T_4$ is sulfur or

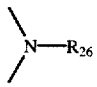

and $R_{26}$ is hydrogen or $C_1$–$C_4$alkyl, or, if n is 3, $R_{17}$ is

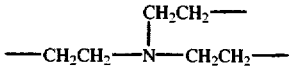

or

-continued

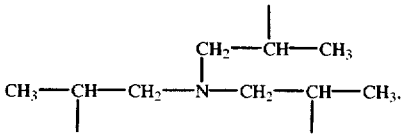

or, if n is 4, $R_{17}$ is

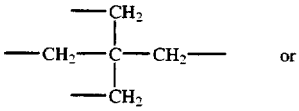

or

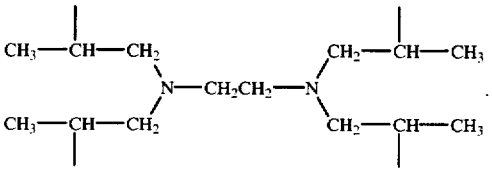

Of particular interest are also compositions comprising as component (β) products in which in the compound of the formula III, $R_{12}$ is tert-butyl, $R_{15}$ is $C_1$–$C_4$alkyl and is bonded in the ortho-position relative to the OH group, s is the number 1, Q is $—C_mH_{2m}—$ and is bonded in the para-position relative to the OH group, where m is the number 2 and n is an integer 1, 2 or 4, where, if n is 1, $R_{17}$ is $C_1$–$C_4$alkyl, or, if n is 2, $R_{17}$ is

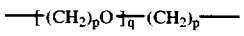

or $—CH_2CH_2—T_4—CH_2CH_2—$, in which p is the number 2, q is the number 2 and $T_4$ is sulfur, or, if n is 4, $R_{17}$ is

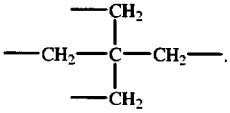

Other preferred compounds of the formula III are

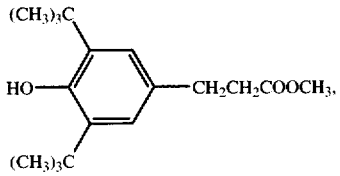

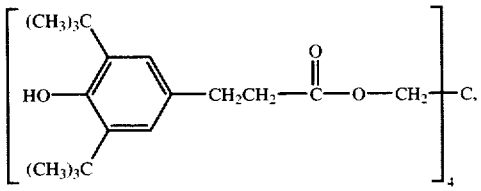

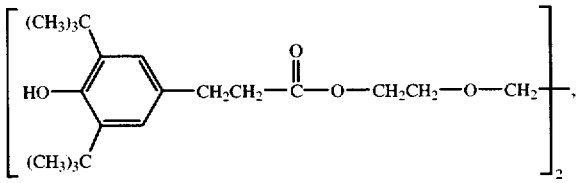

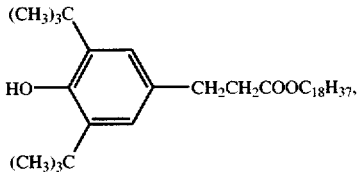

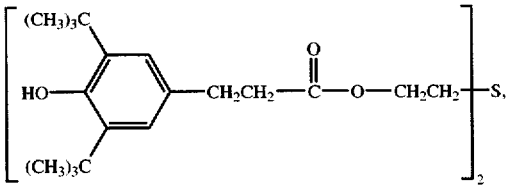

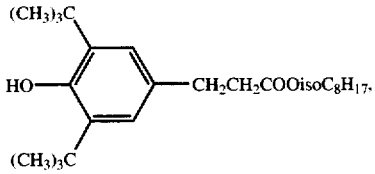

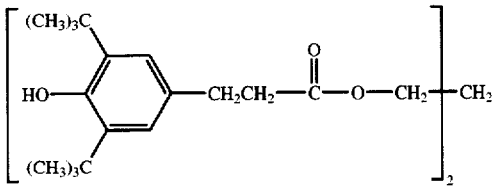

or

-continued

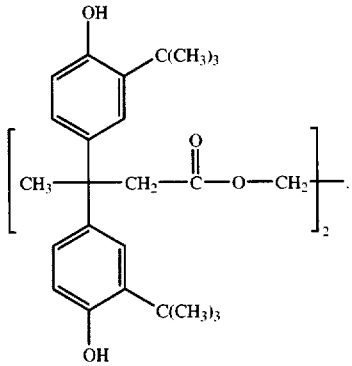

Particularly preferred compounds of the formula III are methyl 3-(3',5'-di-tert-butyl-4'-hydroxyphenyl)propionate and methyl 3-(3'-tert-butyl-4'-hydroxy-5'-methylphenyl) propionate.

Of particular preference are also compositions comprising as component (β) products which can be obtained by reacting components a), b) and c), the component a) being a compound of the formula I, in particular pentaerythritol, thiodiethylene glycol, 1,4-butanediol, 1,2-propanediol, diethylene glycol, triethylene glycol, diethanolamine, glycerol,

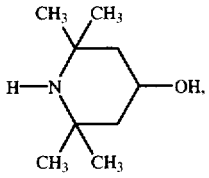

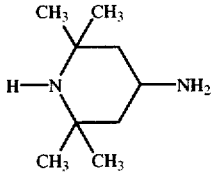

or

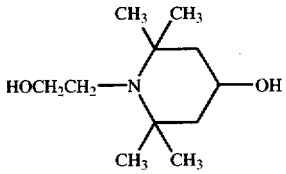

or a mixture of these, component b) is a compound of the formula II, in particular sunflower oil, coconut oil, rapeseed oil, maize germ oil, safflower oil, olive oil, groundnut oil or Radiamuls or a mixture of these, and component c) is a compound of the formula III, in particular methyl 3-(3',5'-ditert-butyl-4'-hydroxyphenyl)propionate or methyl 3-(3'-tert-butyl-4'-hydroxy-5'-methylphenyl)propionate.

The present invention furthermore relates to compositions comprising as component (β) products which can be obtained by reacting components a), b) and c) in a molar quantitative ratio of 0.1:1:0.1 to 15:1:30. A molar quantitative ratio of 1:1:1 to 10:1:20 is preferred. A molar quantitative ratio of 4:1:5 to 10:1:20 is particularly preferred. A molar quantitative ratio of 5:1:10 is especially preferred.

Of special interest are compositions comprising as component (β) products in which the amount by weight of active group E-2

(E-2)

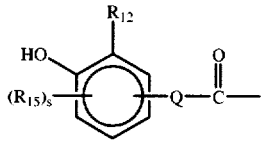

in component (β) is 30 to 80% by weight, preferably 35 to 80% by weight, in particular 50 to 80% by weight As already mentioned, the present products of component (β) possess anti-wear and corrosion inhibiting properties in fuels. Particular mention is made of their outstanding improvement of the lubricity (anti-wear properties) of fuels with lower sulfur and/or aromatic contents.

The present invention therefore also relates to the use of the products of component (β) as anti-wear agent for an engine fuel system.

As a rule, the products of component (β) are added to the fuel in amounts from 0.0001 to 10.0%, preferably 0.001 to 0.2%, in particular 0.005 to 0.1%, based on the weight of component (α).

The products of component (β) may also be blended with liquid carriers, compatible with the end product fuels, to form concentrates for subsequent addition to fuel basestocks or formulated fuels. Such concentrates may facilitate mixing, blending, pouring or transferring (bulk or line) of the products of component (β).

Typically, the carriers are organic solvents for the products of component (β), such as hydrocarbons like for example xylene or toluene, ethers, alcohols or mixtures thereof, or they may be portions of the fuel basestocks or formulated fuels intended as the end products. Addition of the concentrates to basestocks of formulated fuels to form end product fuels may be batchwise, for example from unit containers of concentrates sold at retail or other outlets, or may be added by metering at refineries or fuel distribution sites. Other modes of addition will be evident.

The amount of the products of component (β) in the concentrate may vary, depending on desired concentrate properties such as viscosity. Generally, about 10 to 90% by weight of the products of component (β) in the carrier medium is suitable, more usually about 20 to 50% by weight.

The end product fuels may be hydrocarbon fuels, oxygenates or mixtures of the two. The hydrocarbon fractions which may be used for the fuel compositions include distillate fuels which boil in the kerosene and gas oil range (165 to 565° C.). Typical middle distillate fuels of this kind include road diesel and other diesel fuels with boiling ranges in the range of 200 to 370° C. and jet fuels, kerosenes, gas oil and cycle oils. Such middle distillate fuels may comprise straight run distillate oils, catalytically or thermally cracked distillate fuel oils or mixtures of straight run distillate fuel oils, napthas and like stock with cracked distillate stocks. These fuels are normally derived from petroleum but they may be derived at least in part from other sources such as shale, tar sands, coal, lignite, biomass and similar sources. The fuels may contain a propertion of oxygenate blending components such as alcohols or ethers including methyl tert-butyl ether (MTBE). The fuels may also wholly comprise oxygenates such as methanol and/or ethanol. The fuels may also be those which have been subjected to conventional treatment processes such as treatment with acid or base, hydrogenation, solvent refining or clay treatment.

Of particular interest are compositions comprising as component (α) a diesel fuel.

The fuels may be used for example in the operation of a jet engine, a motor vehicle engine, a gas turbine engine or a diesel engine. In a preferred embodiment of this invention, the fuel is one which is suitable for use in a diesel engine.

The composition of these diesel fuels varies widely with the nature of the crude oil, the refining process, the components with which the raw fuel is blended, and the climate in which the fuel is to be marketed. As noted above, this invention finds particular application in diesel fuels having a reduced sulfur and/or aromatic content which are now being produced in order to comply with regulatory requirements. These fuels typically have sulfur contents below 500 ppm (0.05%) and/or an aromatic content of less than 35% by weight.

Of particular interest are therefore also compositions comprising as component (α) a fuel which contains less than 0.10%, preferably less than 0.05%, in particular less than 0.01% by weight of sulfur.

The composition of the fuel and hence its inherent lubricity may vary according to the severity of the local regulatory regime.

The invention also finds application in aviation fuels such as those commonly used in jet turbine engines. Such fuels have a composition close to that of the diesel fuels having low aromatic and low sulfur content. The addition of the products of component (β) of this invention to these fuels can reduce wear in the engine.

The invention may also find application to unleaded or reformulated automotive fuels as are now commonly used in piston engines in aircraft and motor vehicles. The addition of the products of component (β) to these fuels may improve ingine performance and enable the fuel to be substituted for leaded fuel in uses such as piston engine aircraft where leaded fuel is currently used.

The invention therefore also relates to a process for the reduction of wear in an engine fuel system, which comprises adding a product of component (β) to the fuel.

In addition to the products of component (β), the compositions according to the invention can also contain conventional additives which are added to improve the basic properties of fuel even further as disclosed in the Handbook "Lubricant and Fuel Additives" published by Kline & Company, Inc. International Business Consultants, Fairfield, N.J., USA, pages 309–320 (1990); these include: antioxidants, metal passivators, rust inhibitors, viscosity index improvers, pour-point depressants, dispersants, detergents, high-pressure additives, antifriction additives, antiwear additives, demulsifying agents, cloud point depressants, waxy anti-settling additives, anti-static additives, anti-foams, dehazer additives, biocides, odor masks, dyes, cetane improvers, antiicings, antiknock additives, conductivity improvers, PFI/IVD cleanliness additives and other lubricity additives.

Examples of such conventional additives are the following:

1. Antioxidants 1.1. Alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4, 6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6-(1'-methylundec-1'-yl)phenol, 2,4-dimethyl-6-(1'-methylheptadec-1'-yl)phenol, 2,4-di-methyl-6-(1'-methyltridec-1'-yl)phenol and mixtures thereof.

1.2. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate.

1.3. Alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercaptobutane, ethylene glycol bis[3,3-bis(3'-tert-butyl-4'-hydroxyphenyl) butyrate], bis(3-tert-butyl-4-hydroxy-5-methyl-phenyl) dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy2-methylphenyl)-4-n-dodecylmercaptobutane, 1,1,5,5-tetra-(5-tert-butyl-4-hydroxy2-methylphenyl)pentane.

1.4. O- and N-benzyl compounds, for example 3,5,3',5'-tetra-tert-butyl-4,4'-dihydroxydibenzyl ether or tris-(3,5-di-tert-butyl-4-hydroxybenzyl)amine.

1.5. Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl)malonate.

1.6. Aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol.

1.7. Triazine Compounds, for example 2,4,6-tris(3,5-di-tert-butyl-4-hydroxyphenoxy)-1,2,3-triazine, 1,3,5-tris-(3,5-di-tert-butyl-4-hydroxybenzyl)isocyanurate, 1,3,5-tris(4-tert-butyl-3-hydroxy-2,6-dimethylbenzyl)isocyanurate, 2,4,6-tris(3,5-di-tert-butyl-4-hydroxyphenylethyl)-1,3,5-triazine, 1,3,5-tris(3,5-di-tert-butyl-4-hydroxyphenyl-propionyl)-hexahydro-1,3,5-triazine, 1,3,5-tris(3,5-dicyclohexyl-4-hydroxybenzyl)isocyanurate.

1.8. Benzylphosphonates, for example dimethyl-2,5-di-tert-butyl-4-hydroxybenzylphosphonate, diethyl-3,5-di-tert-butyl-4-hydroxybenzylphosphonate, dioctadecyl-3,5-di-tert-butyl-4-hydroxybenzylphosphonate, dioctadecyl-5-tert-butyl-4-hydroxy-3-methylbenzyl-phosphonate, the calcium salt of the monoethyl ester of 3,5-di-tert-butyl-4-hydroxybenzyl-phosphonic acid.

1.9. Acylaminophenols, for example 4-hydroxylauranilide, 4-hydroxystearanilide, octyl N-(3,5-di-tert-butyl-4-hydroxyphenyl)carbamate.

1.10. Esters of β-(3,5-di-tert-butyl-4-hydroxyphenyl) propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.11. Esters of β-(5-tert-butyl-4-hydroxy-3-methylphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.12. Esters of β-(3,5-dicyclohexyl-4-hydroxyphenyl) propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2. 2]octane.

1.13. Esters of 3,5-di-tert-butyl-4hydroxyphenyl acetic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.14. Amides of β-(3,5-di-tert-butyl-4-hydroxyphenyl) propionic acid e.g. N,N'-bis(3,5-di-tert-butyl-4-hydroxyphenylpropionyl)hexamethylenediamine, N,N'-bis (3,5-di-tert-butyl-4-hydroxyphenylpropionyl) trimethylenediamine, N,N'-bis(3,5-di-tert-butyl-4-hydroxyphenylpropionyl)hydrazine.

Examples of aminic antioxidants:

N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylaminomethylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino) propane, (o-tolyl)biguanide, bis[4-(1',3'-dimethylbutyl) phenyl]amine, tert-octylated N-phenyl-1-naphthylamine, a mixture of mono- and dialkylated tert-butyl/tert-octyldiphenylamines, a mixture of mono- and dialkylated isopropyvisohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethylpiperid-4-yl) sebacate, 2,2,6,6-tetramethylpiperidin-4-one and 2,2,6,6-tetramethylpiperidin-4-ol.

Examples of other antioxidants:

Aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,11-trithiatridecane and 2,2,15,15-tetramethyl-5,12-dihydroxy-3,7,10,14-tetrathiahexadecane.

Examples of metal deactivators, for example for copper, are:

a) Benzotriazoles and derivatives thereof, for example 4- or 5-alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl) aminomethyl)tolutriazole and 1-[bis(2-ethylhexyl) aminomethyl)benzotriazole; and alkoxyalkylbenzotriazoles such as 1-(nonyloxymethyl) benzotriazole, 1-(1-butoxyethyl)benzotriazole and 1-(1-cyclohexyloxybutyl)tolutriazole.

b) 1,2,4-Triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles.

c) Imidazole derivatives, for example 4,4'-methylenebis(2-undecyl-5-methylimidazole) and bis[(N-methyl) imidazol-2-yl]carbinol octyl ether.

d) Sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one.

e) Amino compounds, for example salicylidenepropylenediamine, salicylaminoguanidine and salts thereof.

Examples of rust inhibitors are:

a) Organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof.

b) Nitrogen-containing compounds, for example:

I. Primary, secondary or tertiary aliphatic or cycloaliphatic amines and amine salts of organic and inorganic acids, for example oil-soluble alkylammonium carboxylates, and also 1-[N,N-bis(2-hydroxyedlyl)amino]-3-(4-nonylphenoxy)propan-2-ol.

II. Heterocyclic compounds, for example: substituted imidazolines and oxazolines, and 2-heptadecenyl-1-(2-hydroxyethyl)imidazoline.

c) Phosphorus-containing compounds, for example: Amine salts of phosphoric acid partial esters or phosphonic acid partial esters, and zinc dialkyldithiophosphates.

d) Sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof.

e) Glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols.

Examples of viscosity index improvers are:

Polyacrylates, polymethacrylates, vinylpyrrolidonet-methacrylate copolymers, polyvinyl-pyrrolidones, polybutenes, olefin copolymers, styrene/acrylate copolymers and polyethers.

Examples of pour-point depressants are:

Polymethacrylate and alkylated naphthalene derivatives.

Examples of dispersants/surfactants are:

Polybutenylsuccinic amides or -imides, polybutenylphosphonic acid derivatives and basic magnesium, calcium and barium sulfonates and phenolates.

Examples of antiwear additives are:

Sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, di- ethanolaminomethyltolyltriazole, bis(2-ethylhexyl) aminomethyltolyltriazole, derivatives of 2,5-dimercapto-1,3,4-thiadiazole, ethyl 3-[(diisopropoxyphosphinothioyl) thio]propionate, triphenyl thiophosphate (triphenylphosphorothioate), tris(alkylphenyl) phosphorothioate and mixtures thereof (for example tris (isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris [isooctyl 2-acetate], derivatives of 2-mercaptobenzothiazole such as 1-[N,N-bis(2-ethylhexyl)aminomethyl]-2-mercapto-1H-1,3-benzothiazole, and ethoxycarbonyl-5-octyldithiocarbamate.

The conventional additives are added for example at concentrations of 0.01 to 10% based on the total weight of the fuel.

The products of component (β) of this invention may be combined with any of these additives provided the components of such mixtures are mutually compatible.

The products of component (β) of this invention may be added separately to the fuel or they may be combined with one or more of the additives described to produce an additive formulation which is suitable for addition to a base fuel.

The examples which follow illustrate the invention in greater detail. Parts and percentages are by weight, unless otherwise indicated.

EXAMPLE 1

Preparation of the sunflower oil derivatives using pentaerythritol and methyl 3-(3',5'-di-tert-butyl-4'-hydroxyphenyl)propionate In a sulfonation flask equipped with reflux condenser and mechanical stirrer, a mixture of 30 g (~34 mmol) sunflower oil, 4.64 g (34 mmol) of pentaerythritol and 37 mg (0.15 mmol) of dibutyltin oxide is kept under nitrogen for 7 hours at 180–190° C. 9.94 g (34 mmol) of methyl 3-(3',5'-di-tert-butyl-4'-hydroxyphenyl)propionate and another 37 mg (0.15 mmol) of dibutyltin oxide are subsequently added. Stirring of the reaction mixture is continued for 15 hours at 180–190° C. When cold, 40.64 g (91%) of product are obtained as a yellow oil having a refractive index $n_D^{20}$ of 1.4882.

EXAMPLE 2

Preparation of the coconut oil derivatives using pentaerythritol and methyl 3-(3',5'-di-tert-butyl-4'-hydroxyphenyl)propionate The procedure described in Example 1 is repeated, except that 403 g (~0.616 mol) of coconut fat, 83.1 g (0.610 mol) of pentaerythritol, 1.0 g (4 mmol) of dibutyltin oxide and 178.4 g (0.610 mol) of methyl 3-(3',5'-di-tert-butyl-4'-hydroxyphenyl)propionate are used, affording 653 g (98%) of product as a brown oil having a refractive index $n_D^{20}$ of 1.4781.

EXAMPLE 3

Preparation of the sunflower oil derivatives using thiodiethylene glycol and methyl 3-(3',5'-di-tert-butyl-4'-hydroxyphenyl)propionate The procedure described in Example 1 is repeated, except that 50 g (~57 mmol) of sunflower oil, 41.8 g (343 mmol) of thiodiethylene glycol, 448 mg (1.8 mmol) of dibutyltin oxide and 200 g (684 mmol) of methyl 3-(3',5'-di-tert-butyl-4'-hydroxyphenyl)propionate are used, affording 279.1 g (96%) of product as a yellow oil with a refractive index $n_D^{20}$ of 1.5170.

EXAMPLE 4

Preparation of the coconut oil derivatives using thiodiethylene glycol and methyl 3-(3',5'-di-tert-butyl-4'-hydroxyphenyl)propionate The procedure described in Example 1 is repeated, except that 49.9 g (~76 mmol) of coconut fat, 85.1 g (688 mmol) of thiodiethylene glycol, 797 mg (3.2 mmol) of dibutyltin oxide and 402.6 g (1.38 mol) of methyl 3-(3',5'-di-tert-butyl-4'-hydroxyphenyl)propionate are used, affording 500.7 g (93%) of product as a brownish orange oil having a refractive index $n_D^{20}$ of 1.5210.

EXAMPLE 5

Preparation of the sunflower oil derivatives using 1, 4-butanediol and methyl 3-(3',5'-di-tert-butyl-4'-hydroxyphenyl)propionate The procedure described in Example 1 is repeated, except that 30 g (~34 mmol) sunflower oil, 14 g (155 mmol) of 1,4-butanediol, 199 mg (0.80 mmol) of dibutyltin oxide and 87.7 g (300 mmol) of methyl 3-(3',5'-di-tert-butyl-4'-hydroxyphenyl)propionate are used, affording 124 g (94%) of product as a reddish oil having a refractive index $n_D^{20}$ of 1.5070.

EXAMPLE 6

Preparation of the coconut oil derivatives using 1, 4-butanediol and methyl 3-(3',5'-di-tert-butyl-4'-hydroxyphenyl)propionate The procedure described in Example 1 is repeated, except that 30 g (~46 mmol) of coconut fat, 14 g (155 mmol) of 1,4-butanediol, 199 mg (0.80 mmol) of dibutyltin oxide and 87.7 g (300 mmol) of methyl 3-(3',5'-di-tert-butyl-4'-hydroxyphenyl)propionate are used, affording 123 g (93%) of product as a reddish oil with a refractive index $n_D^{20}$ of 1.5025.

EXAMPLE 7

Preparation of the sunflower oil derivatives using 1, 2-propanediol and methyl 3-(3',5'-di-tert-butyl-4'-hydroxyphenyl)propionate The procedure described in Example 1 is repeated, except that 30 g (~34 mmol) of sunflower oil, 12.2 g (160 mmol) of 1,2-propanediol, 199 mg (0.80 mmol) of dibutyltin oxide and 87.7 g (300 mmol) of methyl 3-(3',5'-di-tert-butyl-4'-hydroxyphenyl)propionate are used, affording 121.7 g (93.7%) of product as a yellow oil having a refractive index $n_D^{20}$ of 1.5047.

EXAMPLE 8

Preparation of the sunflower oil derivatives using diethylene glycol and methyl 3-(3',5'-di-tert-butyl-4'-hydroxyphenyl)propionate The procedure described in Example 1 is repeated, except that 30.1 g (~34 mmol) of sunflower oil, 16.7 g (157 mmol) of diethylene glycol, 199 mg (0.80 mmol) of dibutyltin oxide and 89.5 g (306 mmol) of methyl 3-(3',5'-di-tert-butyl-4'-hydroxyphenyl)propionate are used, affording 137.3 g (99%) of product as a yellow oil having a refractive index $n_D^{20}$ of 1.5065.

EXAMPLE 9

Preparation of the coconut oil derivatives using diethylene glycol and methyl 3-(3',5'-di-tert-butyl-4'-hydroxyphenyl)propionate The procedure described in Example 1 is repeated, except that 30 g (~46 mmol) of coconut fat, 22.3 g (210 mmol) of diethylene glycol, 249 mg (1.00 mmol) of dibutyltin oxide and 121.1 g (414 mmol) of methyl 3-(3',5'-di-tert-butyl-4'-hydroxyphenyl)propionate are used, affording 158.1 g (91%) of product as a yellow oil with a refractive index $n_D^{20}$ of 1.5068.

EXAMPLE 10

Preparation of the sunflower oil derivatives using triethylene glycol and methyl 3-(3',5'-di-tert-butyl-4'-hydroxyphenyl)propionate The procedure described in Example 1 is repeated, except that 30 g (~34 mmol) of sunflower oil, 15 g (100 mmol) of triethylene glycol, 199 mg (0.80 mmol) of dibutyltin oxide and 90.65 g (310 mmol) of methyl 3-(3',5'-di-tert-butyl-4'-hydroxyphenyl)propionate are used, affording 129 g (95%) of product as a pale yellow oil having a refractive index $n_D^{20}$ of 1.5050.

EXAMPLE 11

Preparation of the coconut oil derivatives using triethylene glycol and methyl 3-(3',5'-di-tert-butyl-4'-hydroxyphenyl)propionate The procedure described in Example 1 is repeated, except that 30 g (~46 mmol) of coconut fat, 15.2 g (100 mmol) of triethylene glycol, 199 mg (0.80 mmol) of dibutyltin oxide and 90.65 g (310 mmol) of methyl 3-(3',5'-di-tert-butyl-4'-hydroxyphenyl)propionate are used, affording 129.5 g (95%) of product as a pale yellow oil having a refractive index $n_D^{20}$ of 1.4992.

EXAMPLE 12

Preparation of the Radiamuls derivatives using diethylene glycol and methyl 3-(3',5'-di-tert-butyl-4'-hydroxyphenyl)propionate The procedure described in Example 1 is repeated, except that 30 g (~59 mmol) of Radiamuls (glycerol tri $C_8/C_{10}$), 16.3 g (154 mmol) of diethylene glycol, 224 mg (0.90 mmol) of dibutyltin oxide and 95.6 g (327 mmol) of methyl 3-(3',5'-di-tert-butyl-4'-hydroxyphenyl)propionate are used, affording 132.6 g (99%) of product as a pale yellow oil having a refractive index $n_D^{20}$ of 1.5022.

EXAMPLE 13

Preparation of the sunflower oil derivatives using diethanolamine and methyl 3-(3',5'-di-tert-butyl-4'-hydroxyphenyl)propionate The procedure described in Example 1 is repeated, except that 60 g (~68 mmol) of sunflower oil, 14.3 g (136 mmol) of diethanolamine, 149 mg (0.60 mmol) of dibutyltin oxide and 19.9 g (68 mmol) of methyl 3-(3',5'-di-tert-butyl-4'-hydroxyphenyl)propionate are used, affording 88.4 g (95%) of product as a brownish red oil having a refractive index $n_D^{20}$ of 1.4940.

EXAMPLE 14

Preparation of the coconut oil derivatives using diethanolamine and methyl 3-(3',5'-di-tert-butyl-4'-hydroxyphenyl)propionate The procedure described in Example 1 is repeated, except that 60 g (~92 mmol) of coconut fat, 19.1 g (182 mmol) of diethanolamine, 174 mg (0.70 mmol) of dibutyltin oxide and 34.2 g (117 mmol) of methyl 3-(3',5'-di-tert-butyl-4'-hydroxyphenyl)propionate are used, affording 104.9 g (93%) of product as a brown oil having a refractive index $n_D^{20}$ of 1.4905.

EXAMPLE 15

Preparation of the sunflower oil derivatives using glycerol and methyl 3-(3',5'-di-tert-butyl-4'-hydroxyphenyl)propionate The procedure described in Example 1 is repeated, except that 30 g (~34 mmol) of sunflower oil, 14.22 g (154 mmol) of glycerol, 199 mg (0.80 mmol) of dibutyltin oxide and 87.73 g (300 mmol) of methyl 3-(3',5'-di-tert-butyl-4'-hydroxyphenyl)propionate are used, affording 126.5 g (96%) of product as a pale yellow, viscous oil having a refractive index $n_D^{20}$ of 1.5128.

EXAMPLE 16

Preparation of the coconut oil derivatives using glycerol and methyl 3-(3',5'-di-tert-butyl-4'-hydroxyphenyl)propionate The procedure described in Example 1 is repeated, except that 30 g (about 46 mmol) of coconut fat, 19.4 g (211 mmol) of glycerol, 249 mg (1.0 mmol) of dibutyltin oxide and 118 g (404 mmol) of methyl 3-(3',5'-di-tert-butyl-4'-hydroxyphenyl)propionate are used, affording 154 g (92%) of product as a pale yellow, viscous oil having a refractive index $n_D^{20}$ of 1.5123.

EXAMPLE 17

Preparation of the sunflower oil derivatives using glycerol and methyl 3-(3'-tert-butyl-4'-hydroxy-5'-methylphenyl)propionate The procedure described in Example 1 is repeated, except that 30 g (~34 mmol) of sunflower oil, 14.5 g (157 mmol) of glycerol, 180 mg (0.72 mmol) of dibutyltin oxide and 75.20 g (300 mmol) of methyl 3-(3'-tert-butyl-4'-hydroxy-5'-methylphenyl)propionate are used, affording 105.0 g (96%) of product as an orange oil having a refractive index $n_D^{20}$ of 1.5165.

EXAMPLE 18

Preparation of the coconut oil derivatives using diethylene glycol and methyl 3-(3'-tert-butyl-4'-hydroxy-5'-methylphenyl)propionate The procedure described in Example 1 is repeated, except that 30 g (~46 mmol) of coconut fat, 22.6 g (213 mmol) of diethylene glycol, 184 mg (0.70 mmol) of dibutyltin oxide and 94.3 g (390 mmol) of methyl 3-(3'-tert-butyl-4'-hydroxy-5'-methylphenyl)propionate are used, affording 131.9 g (98%) of product as a yellow oil having a refractive index $n_D^{20}$ of 1.5118.

EXAMPLE 19

Preparation of the sunflower oil derivatives using 4-hydroxy-2,2,6,6-tetramethylpiperidine and methyl 3-(3',5'-di-tert-butyl-4'-hydroxyphenyl)propionate The procedure described in Example 1 is repeated, except that 41.5 g (~47 mmol) of sunflower oil, 7.90 g (50 mmol) of 4-hydroxy-2,2,6,6-tetramethylpiperidine, 50 mg (0.20 mmol) of dibutyltin oxide and 14.60 g (50 mmol) of methyl 3-(3',5'-di-tert-butyl-4'-hydroxyphenyl)propionate are used, affording 59.4 g (95%) of product as a brown oil having a refractive index $n_D^{20}$ of 1.4848.

EXAMPLE 20

Preparation of the sunflower oil derivatives using 4-amino-2,2,6,6-tetramethylpiperidine and methyl 3-(3',5'-di-tert-butyl-4'-hydroxyphenyl)propionate The procedure described in Example 1 is repeated, except that 41.5 g (~47 mmol) of sunflower oil, 7.80 g (50 mmol) of 4-amino-2,2,6,6-tetramethylpiperidine, 50 mg (0.20 mmol) of dibutyltin oxide and 14.60 g (50 mmol) of methyl 3-(3',5'-di-tert-butyl-4'-hydroxyphenyl)propionate are used, affording 61.8 g (99%) of product as a brown oil having a refractive index $n_D^{20}$ of 1.4887.

EXAMPLE 21

Preparation of the coconut oil derivatives using N-(2-hydroxyethyl)-4-hydroxy-2,2,6,6-tetramethylpiperidine and methyl 3-(3',5'-di-tert-butyl-4'-hydroxyphenyl)propionate.

The procedure described in Example 1 is repeated, except that 31.0 g (~47 mmol) of coconut fat, 10.1 g (50 mmol) of N-(2-hydroxyethyl)-4-hydroxy-2,2,6,6-tetramethylpiperidine, 50 mg (0.20 mmol) of dibutyltin oxide and 14.60 g (50 mmol) of methyl 3-(3',5'-di-tert-butyl-4'-hydroxyphenyl)propionate are used, affording 52.4 g (98%) of product as a yellow oil having a refractive index $n_D^{20}$ of 1.4811.

EXAMPLE 22

Preparation of the rapeseed oil derivatives using glycerol and methyl 3-(3',5'-di-tert-butyl-4'-hydroxyphenyl)propionate In a sulfonation flask equipped with reflux condenser and mechanical stirrer, a mixture of 116.3 g (~134 mmol) of rapeseed oil, 86.1 g (935 mmol) of 85% aqueous glycerol and 2.64 g (15.0 mmol) of calcium acetate is kept for 7 hours under a nitrogen atmosphere at 180–190° C. 357.5 g (1.22 mol) of methyl 3-(3',5'-di-tert-butyl-4'-hydroxyphenyl) propionate are subsequently added. Stirring of the reaction mixture is continued for 15 hours at 180–190° C. After cooling, 505 g (99%) of product are obtained as a yellow oil having a refractive index $n_D^{20}$ of 1.5122.

EXAMPLE 23

Preparation of the maize germ oil derivatives using glycerol and methyl 3-(3',5'-di-tert-butyl-4'-hydroxyphenyl)propionate The procedure described in Example 22 is repeated, except that 100 g (~113 mmol) of maize germ oil, 57.5 g (624 mmol) of 85% aqueous glycerol, 2.32 g (13.0 mmol) of calcium acetate and 282.4 g (966 mmol) of methyl 3-(3',5'-di-tert-butyl-4'-hydroxyphenyl)propionate are used, affording 399.0 g (99%) of product as a yellow oil having a refractive index $n_D^{20}$ of 1.5127.

EXAMPLE 24

Preparation of the safflower oil derivatives using glycerol and methyl 3-(3',5'-di-tert-butyl-4'-hydroxyphenyl)propionate The procedure described in Example 22 is repeated, except that 100 g (~113 mmol) of safflower oil, 57.6 g (625 mmol) of 85% aqueous glycerol, 2.11 g (12.0 mmol) of calcium acetate and 286.5 g (980 mmol) of methyl 3-(3',5'-di-tert-butyl-4'-hydroxyphenyl)propionate are used, affording 403.2 g (99%) of product as a yellow oil having a refractive index $n_D^{20}$ of 1.5140.

EXAMPLE 25

Preparation of the olive oil derivatives using glycerol and methyl 3-(3',5'-di-tert-butyl-4'-hydroxyphenyl)propionate The procedure described in Example 22 is repeated, except that 100 g (~114 mmol) of olive oil, 58.0 g (630 mmol) of 85% aqueous glycerol, 2.11 g (12.0 mmol) of calcium acetate and 290.4 g (993 mmol) of methyl 3-(3',5'-di-tert-butyl-4'-hydroxyphenyl)propionate are used, affording 408.6 g (99%) of product as a yellow oil having a refractive index $n_D^{20}$ of 1.5110.

EXAMPLE 26

Preparation of the groundnut oil derivatives using glycerol and methyl 3-(3',5'-di-tert-butyl-4'-hydroxyphenyl)propionate The procedure described in Example 22 is repeated, except that 100 g (~114 mmol) of groundnut oil, 58.0 g (630 mmol) of 85% aqueous glycerol, 2.11 g (12.0 mmol) of calcium acetate and 291.4 g (997 mmol) of methyl 3-(3',5'-di-tert-butyl-4'-hydroxyphenyl)propionate are used, affording 413.5 g (99%) of product as a yellow oil having a refractive index $n_D^{20}$ of 1.5100.

EXAMPLE 27

HFRR (High Frequency Reciprocating Rig) test for low sulfur diesel fuel

The anti-wear properties of the products of component (β) in low sulfur diesel fuel (available from EMPA, Switzerland) has been tested using the HFFR fuel lubricity tester under the conditions prescribed by the CEC F-06-A-96 test method which is available from CEC Secretariat, Place Madou 1, B-1030 Brussells, Belgium; or SAE Order Department 782, 400 Commonwealth Drive, Warrendale, Pa. 15096, USA. Details of the test method are disclosed for example in Wei Dan Ping and H. A. Spikes, Wear, 111, 217–235 (1986) or Wei Dan Ping, S. Korcek and H. A. Spikes, SAE 962010.

With the HFFR tester the lubricity of a fuel sample is assessed through the measurement of the wear occurring after 75 minutes of an oscillating displacement of a steel ball against a flat disk. The ball diameter is 6.00 mm, the frequency of the displacement is 50 Hertz, its stroke length is 1 mm and the load applied on the ball is 200 g. The ball and the flat disk are immersed in the fuel to be tested. Other conditions like relative humidity do influence the results and must be hold within the prescribed limits. At the end of the test duration, the diameter of the wear scar on the ball is measured and a correction is applied which normalises all results to a standard water vapour pressure of 14 mbar. The results are reported in micometer (μm). A high lubricity and a low lubricity reference fuel are available for the calibration. The high lubricity fuel gives a wear scar in the range of 380 to 437 μm. The low lubricity fuel gives a wear scar in the range of 600 to 760 μm. Both fuels are available via the CEC working group. The lower the wear scar the better are the anti-wear properties of the products of component (β) in the low sulfur diesel fuel. The results are summarized in Table 1.

TABLE 1

HFFR test for low sulfur diesel fuel

| Example | Additive | Amount | Wear Scar (μm) |
|---|---|---|---|
| 27a | — | — | 650 |
| 27b | Product of | 0.03% | 260 |
| | Example 16 | 0.04% | 220 |

What is claimed is:

1. A process for the reduction of wear in the fuel system of a diesel engine, which comprises contacting said engine fuel system with a fuel having a reduced sulfur and aromatics content and comprising an effective anti-wear amount of a product obtainable by reacting components a), b) and c), where component a) is a compound of the formula I or a mixture of compounds of the formula I, component b) is a compound of the formula II or a mixture of compounds of the formula II and component c) is a compound of the formula III or a mixture of compounds of the formula III, (I)

$X(Y)_a$, (II)

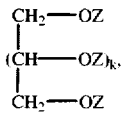

(III)

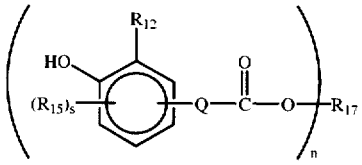

in which, in the compound of the formula I, the radicals Y independently of one another are OH, $(HOCH_2CH_2)_2N$— or —$HNR_1$ and the radicals $R_1$ are hydrogen, $C_1$–$C_{18}$alkyl, $C_5$–$C_{12}$cycloalkyl,

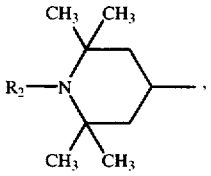

$C_3$–$C_6$alkenyl, $C_7$–$C_9$phenylalkyl, phenyl, or phenyl which is substituted by 1 to 3 radicals $A_1$, the radicals $A_1$ independently of one another being $C_1$–$C_{12}$alkyl, halogen, hydroxyl, methoxy or ethoxy, in which $R_2$ is hydrogen, $C_1$–$C_8$alkyl, O., OH, NO, —$CH_2CN$, $C_1$–$C_{18}$alkoxy, $C_5$–$C_{12}$cycloalkoxy, $C_3$–$C_6$alkenyl, $C_7$–$C_9$phenylalkyl or $C_7$–$C_9$phenylalkyl which is mono-, di- or trisubstituted on the phenyl ring by $C_1$–$C_4$alkyl, or $R_2$ is furthermore $C_1$–$C_8$acyl or $HOCH_2CH_2$—, and a is the number 1, 2, 3, 4 or 6, where, if Y is OH and a is 1, X is $C_1$–$C_{45}$alkyl, $C_3$–$C_{18}$alkenyl, —$CH_2CH_2T_1(CH_2CH_2O)_bR_4$ or

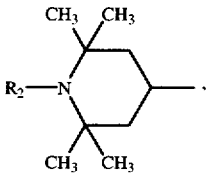

in which $R_2$ is as defined above, and $T_1$ is oxygen, sulfur or

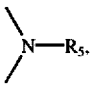

$R_4$ is $C_1$–$C_{20}$alkyl, b is an integer ranging from 0 to 10 and $R_5$ is hydrogen, $C_1$–$C_{18}$alkyl or phenyl, or, if Y is OH and a is 2, X is —$CH_2CH_2T_2(CH_2CH_2O)_bCH_2CH_2$—, in which b is as defined above,

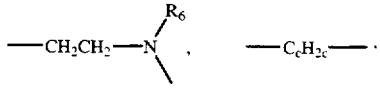

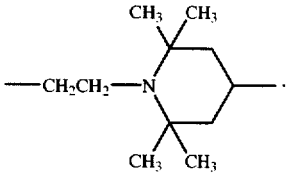

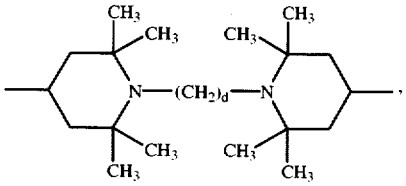

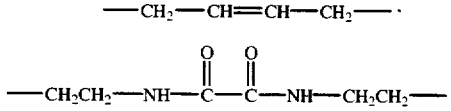

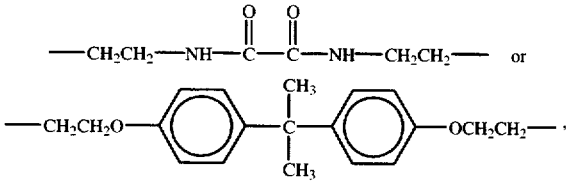

in which $T_2$ is oxygen, sulfur,

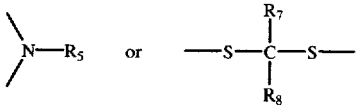

and $R_5$ is as defined above, $R_6$ is hydrogen, $C_1$–$C_{18}$alkyl or phenyl, c is an integer ranging from 2 to 10, d is an integer ranging from 2 to 6 and $R_7$ and $R_8$ independently of one another are hydrogen, $C_1$–$C_{18}$alkyl or phenyl, or $R_7$ and $R_8$ together with the C atom to which they are bonded form a $C_5$–$C_{12}$cycloalkyl ring, or if a is 3, X is $C_3$–$C_{10}$alkanetriyl or $N(CH_2CH_2—)_3$, or, if Y is OH and a is 4, X is $C_4$–$C_{10}$alkanetetrayl,

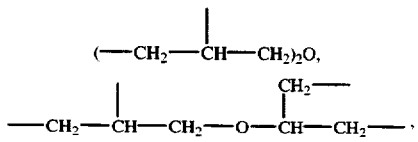

-continued

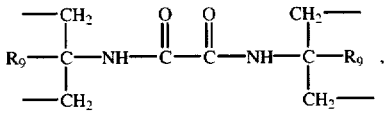

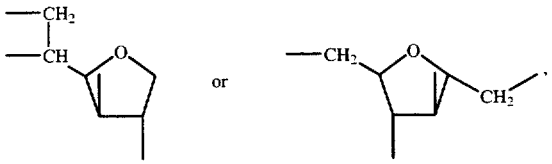

in which $R_9$ is $C_1$–$C_4$alkyl, or, if Y is OH and a is 6,

X is

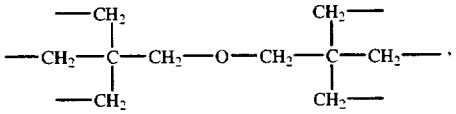

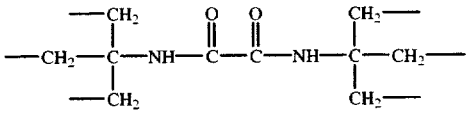

or $C_6$–$C_{10}$alkanehexayl, or, if Y is $HNR_1$ and a is 1,

X is $C_1$–$C_{18}$alkyl, $C_3$–$C_{18}$alkenyl, $C_5$–$C_{12}$cycloalkyl, $C_7$–$C_9$phenylalkyl, phenyl,

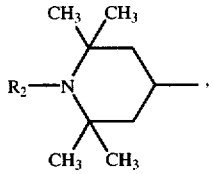

in which $R_2$ is as defined above or X is furthermore

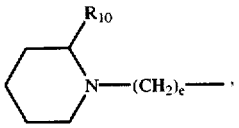

or X together with $R_1$ is a group of the formula —$CH_2CH_2CH_2CH_2CH_2$— or

—$CH_2CH_2OCH_2CH_2$—, in which $R_{10}$ is hydrogen or methyl and e is 2 or 3, or, if Y is —$HNR_1$ and a is 2, X is —$C_fH_{2f}$—,

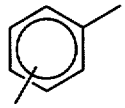

or

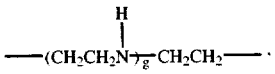

in which f is an integer ranging from 2 to 10 and g is an integer ranging from 1 to 6, and, in the compound of the formula II, the radicals Z are hydrogen or a group of the formula

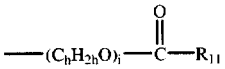

and k is an integer ranging from 0 to 6, in which h is 2or 3, i is an integer ranging from 0 to 12 and $R_{11}$ is $C_1$–$C_{30}$alkyl, $C_8$–$C_{30}$alkenyl, $C_5$–$C_{12}$cycloalkyl, phenyl or $C_7$–$C_9$phenylalkyl, with the proviso that the compound of the formula II has a group

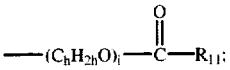

in the compound of the formula III, $R_{12}$ is $C_1$–$C_{18}$alkyl, $C_5$–$C_{12}$cycloalkyl, phenyl or $C_7$–$C_9$phenylalkyl, $R_{15}$ is hydrogen, $C_1$–$C_{18}$alkyl, $C_5$–$C_{12}$cycloalkyl, phenyl or $C_7$–$C_9$phenylalkyl, s is 0, 1 or 2, Q is —$C_mH_{2m}$—,

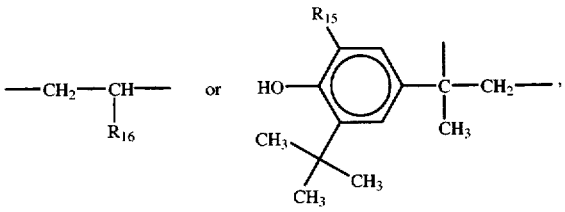

in which $R_{15}$ is as defined above, m is an integer ranging from 0 to 3, $R_{16}$ is $C_1$–$C_8$alkyl and n is an integer ranging from 1 to 6, where, if n is 1, $R_{17}$ is hydrogen, $C_1$–$C_{45}$alkyl, $C_5$–$C_{12}$cycloalkyl, $C_2$–$C_{18}$alkenyl, a monovalent radical of a hexose, a monovalent radical of a hexitol,

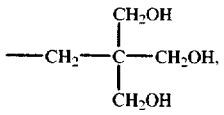

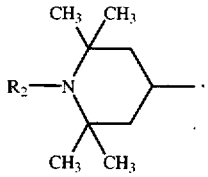

in which $R_2$ is as defined above, or furthermore $R_{17}$ is $—CH_2CH_2—T_3—R_{19}$ or $$—\!\!\left[(CH_2)_pO\right]_q—(CH_2)_pOR_{19},$$

in which $T_3$ is oxygen, sulfur or

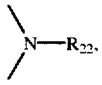

$R_{19}$ is

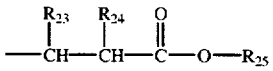

or

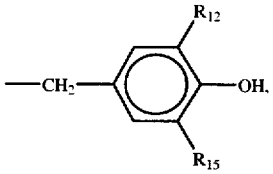

in which $R_{12}$ and $R_{15}$ are as defined above, or $R_{19}$ is furthermore hydrogen, $C_1$–$C_{24}$alkyl, phenyl, $C_5$–$C_{12}$cycloalkyl or

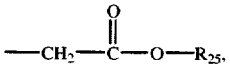

which p is an integ ging from 2 to 4, q is an integer ranging from 2 to 20, $R_{22}$ is $C_1$–$C_{18}$alkyl, phenyl or phenyl which is substituted by 1 to 3 radicals $A_1$, in which the radicals $A_1$ independently of one another are $C_1$–$C_{12}$alkyl, halogen, hydroxyl, methoxy or ethoxy, or $R_{22}$ is furthermore $C_5$–$C_8$cycloalkyl, $R_{23}$ and $R_{24}$ independently of one another are hydrogen or methyl, with the proviso that $R_{23}$ and $R_{24}$ are not simultaneously methyl;

$R_{25}$ is hydrogen or $C_1$–$C_{24}$alkyl, or, if n is 2, $R_{17}$ is a divalent radical of a hexose, a divalent radical of a hexitol,

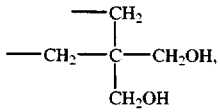

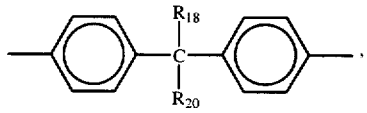

in which p and q are as defined above, $—CH_2CH_2—T_4—CH_2CH_2—$, $—CH_2—CH=CH—CH_2—$, $—CH_2—C\equiv C—CH_2—$,

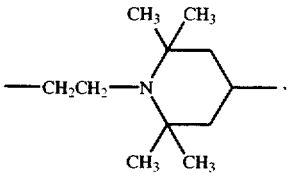

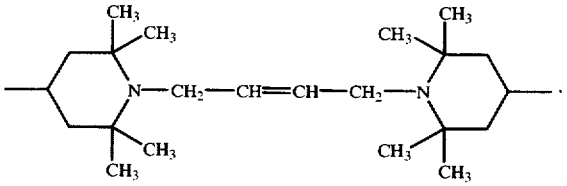

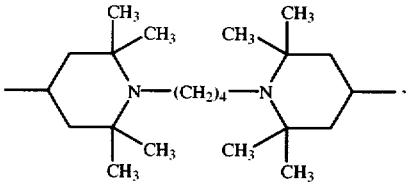

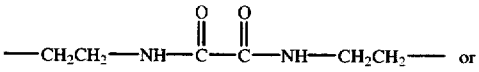

or

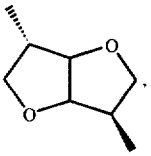

in which $R_{18}$ and $R_{20}$ independently of one another are hydrogen or $C_1$–$C_{12}$alkyl or together are the radical $—CH_2CH_2CH_2CH_2CH_2—$, r is an integer ranging from 2 to 10, $T_4$ is sulfur,

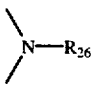

or

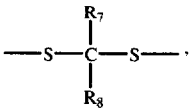

in which $R_7$ and $R_8$ are as defined above, and $R_{26}$ is hydrogen, $C_1$–$C_{18}$alkyl, phenyl or phenyl which is substituted by 1 to 3 radicals $A_1$, in which the radicals $A_1$ are as defined above in formula I, or $R_{26}$ is furthermore $C_5$–$C_8$cycloalkyl or

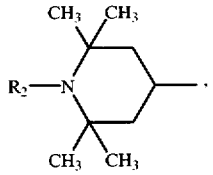

in which $R_2$ is as defined above, or, if n is 3, $R_{17}$ is a trivalent radical of a hexose, a trivalent radical of a hexitol,

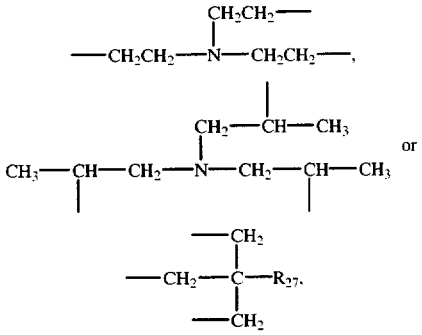

in which $R_{27}$ is hydrogen, $CH_2OH$, $C_1$–$C_4$alkyl, $C_1$–$C_{18}$alkylamido or

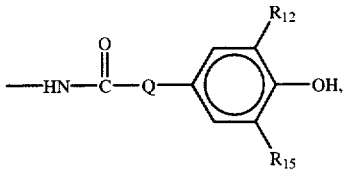

in which Q, $R_{12}$ and $R_{15}$ are as defined above, or, if n is 4, $R_{17}$ is a tetravalent radical of a hexose, a tetravalent radical of a hexitol, $C_4$–$C_{10}$alkanetetrayl,

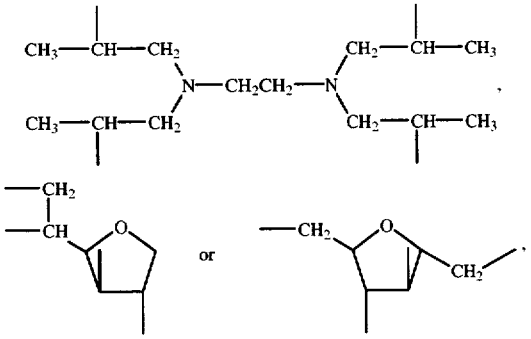

or, if n is 5, $R_{17}$ is a pentavalent radical of a hexose or a pentavalent radical of a hexitol, or, if n is 6, $R_{17}$ is a hexavalent radical of a hexitol or

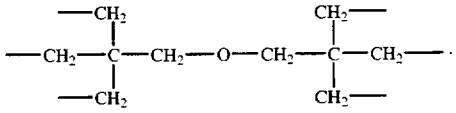

2. A process according to claim 1, in which in the compound of the formula III, s is the number 1 or 2.

3. A process according to claim 1, in which in the compound of the formula I, the radicals Y independently of one another are OH, $(HOCH_2CH_2)_2N$— or —$HNR_1$ and $R_1$ is hydrogen, $C_1$–$C_{10}$alkyl, $C_5$–$C_7$cycloalkyl,

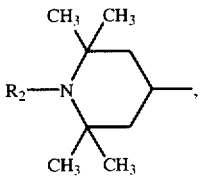

$C_3$–$C_6$alkenyl, benzyl or phenyl, in which $R_2$ is hydrogen, $C_1$–$C_4$alkyl, OH, —$CH_2CN$, $C_6$–$C_{12}$alkoxy, $C_5$–$C_8$cycloalkoxy, allyl, benzyl, acetyl or $HOCH_2CH_2$— and a is the number 1, 2, 3, 4 or 6, where, if Y is OH and a is 1, X is $C_1$–$C_{30}$alkyl, $C_3$–$C_{18}$alkenyl, —$CH_2CH_2T_1(CH_2CH_2O)_bR_4$ or

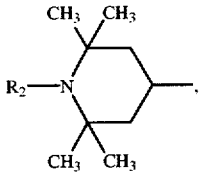

in which $R_2$ is as defined above, $T_1$ is oxygen, sulfur or

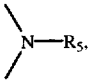

$R_4$ is $C_1$–$C_{10}$alkyl, b is an integer ranging from 0 to 10 and $R_5$ is hydrogen, $C_1$–$C_{10}$alkyl or phenyl, or, if Y is OH and a is 2, X is —$CH_2CH_2T_2(CH_2CH_2O)_bCH_2CH_2$—, in which b is as defined above,

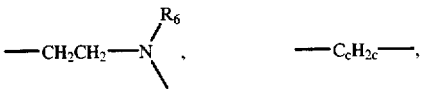

-continued

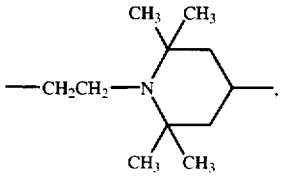

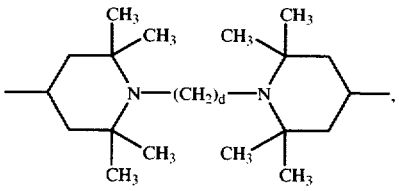

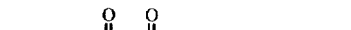

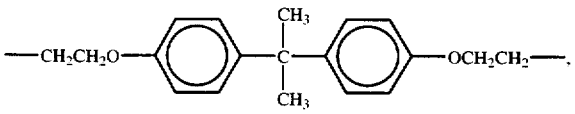

in which $T_2$ is oxygen, sulfur,

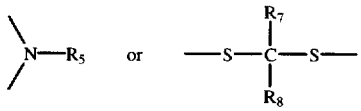

and $R_5$ is as defined above, $R_6$ is hydrogen, $C_1$–$C_{10}$alkyl or phenyl, c is an integer ranging from 2 to 10, d is an integer ranging from 2 to 6 and $R_7$ and $R_8$ independently of one another are hydrogen, $C_1$–$C_{10}$alkyl or phenyl, or $R_7$ and $R_8$ together with the C atom to which they are bonded form a $C_5$–$C_7$cycloalkyl ring, or, if Y is —$HNR_1$ and a is 1, X is $C_1$–$C_{10}$alkyl, $C_3$–$C_{18}$alkenyl, $C_5$–$C_7$cycloalkyl, benzyl, phenyl,

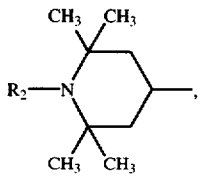

in which $R_2$ is as defined above, or X is furthermore

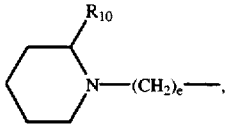

or X together with $R_1$ is a group of the formula —$CH_2CH_2CH_2CH_2CH_2$— or —$CH_2CH_2OCH_2CH_2$—, in which $R_{10}$ is hydrogen or methyl and e is 2 or 3, and in the compound of the formula II, the radicals Z are hydrogen or a group of the formula

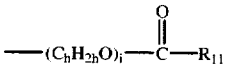

and k is an integer ranging from 0 to 4, in which h is 2 or 3, i is an integer ranging from 0 to 6 and $R_{11}$ is $C_1$–$C_{20}$alkyl, $C_8$–$C_{20}$alkenyl, $C_5$–$C_7$cycloalkyl, phenyl or benzyl, with the proviso that the compound of the formula II comprises a group

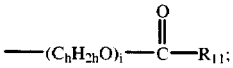

in the compound of the formula III $R_{12}$ is $C_1$–$C_6$alkyl, $C_5$–$C_7$cycloalkyl, phenyl or benzyl $R_{15}$ is hydrogen, $C_1$–$C_6$alkyl, $C_5$–$C_7$cycloalkyl, phenyl or benzyl, s is 1 or 2, Q is —$C_mH_{2m}$—,

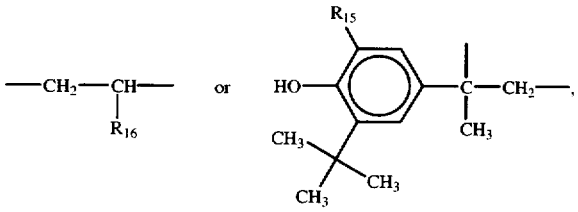

in which $R_{15}$ is as defined above, m is an integer ranging from 0 to 3, $R_{16}$ is $C_1$–$C_4$alkyl and n is an integer ranging from 1 to 6, where, if n is 1, $R_{17}$ is hydrogen, $C_1$–$C_{30}$alkyl, $C_5$–$C_7$cycloalkyl, $C_2$–$C_{18}$alkenyl, a monovalent radical of a hexose, a monovalent radical of a hexitol,

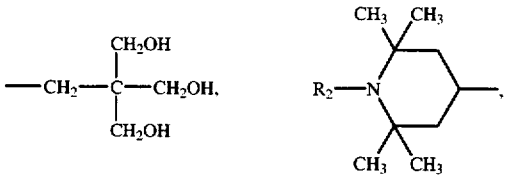

in which $R_2$ is as defined above, or furthermore $R_{17}$ is —$CH_2CH_2$—$T_3$—$R_{19}$ or $$-\!\!\left[(CH_2)_pO\right]_q\!\!-(CH_2)_pOR_{19},$$

in which $T_3$ is oxygen, sulfur or

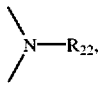

$R_{19}$ is

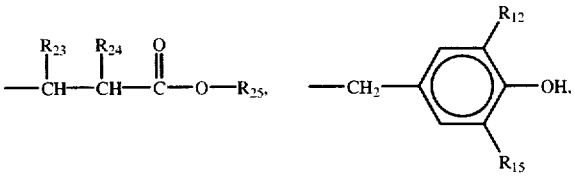

in which $R_{12}$ and $R_{15}$ are as defined above, or $R_{19}$ is furthermore hydrogen, $C_1$–$C_{18}$alkyl, phenyl, $C_5$–$C_7$cycloalkyl or

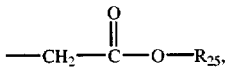

in which p is an integer ranging from 2 to 4, q is an integer ranging from 2 to 20, $R_{22}$ is $C_1$–$C_{10}$alkyl, phenyl or $C_5$–$C_8$cycloalkyl, $R_{23}$ and $R_{24}$ independently of one another are hydrogen or methyl with the proviso that $R_{23}$ and $R_{24}$ are not simultaneously methyl;

$R_{25}$ is hydrogen or $C_1$–$C_{18}$alkyl, or, if n is 2, $R_{17}$ is a divalent radical of a hexose, a divalent radical of a hexitol,

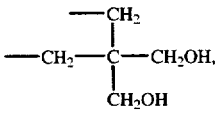

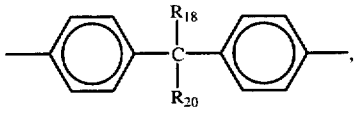

$$-C_rH_{2r}-,\qquad -\!\!\left[(CH_2)_pO\right]_q\!\!-(CH_2)_p-,$$

in which p and q are as defined above, $-CH_2CH_2-T_4-CH_2CH_2-$, $-CH_2-CH=CH-CH_2-$, $-CH_2-C\equiv C-CH_2-$,

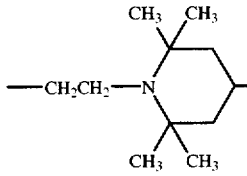

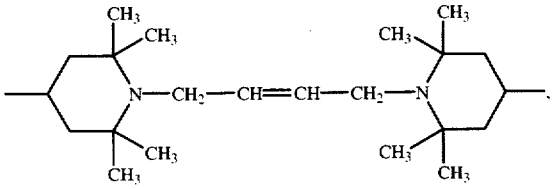

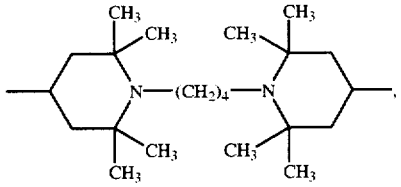

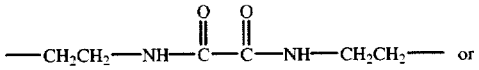

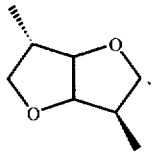

in which $R_{18}$ and $R_{20}$ independently of one another are hydrogen or $C_1$–$C_6$alkyl or together are the radical $-CH_2CH_2CH_2CH_2CH_2-$, r is an integer ranging from 2 to 10, $T_4$ is sulfur,

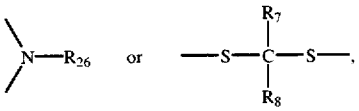

in which $R_7$ and $R_8$ are as defined above and $R_{26}$ is hydrogen, $C_1$–$C_{10}$alkyl, phenyl, $C_5$–$C_8$cycloalkyl or

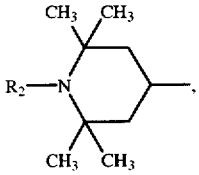

in which $R_2$ is as defined above.

4. A process composition according to claim 1, in which in the compound of the formula I, the radicals Y independently of one another are OH, $(HOCH_2CH_2)_2N-$ or $-HNR_1$ and $R_1$ is hydrogen, $C_1$–$C_4$alkyl or

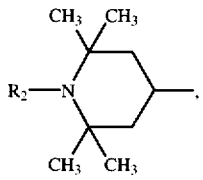

in which $R_2$ is hydrogen, $C_1$–$C_4$alkyl, OH, allyl, benzyl, acetyl or $HOCH_2CH_2$— and a is the number 1, 2, 3, 4 or 6, where, if Y is OH and a is 1, X is $C_1$–$C_{18}$alkyl, $C_3$–$C_{18}$alkenyl, $—CH_2CH_2T_1(CH_2CH_2O)_bR_4$ or

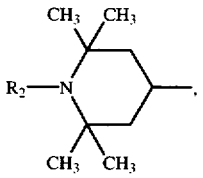

in which $R_2$ is as defined above, and $T_1$ is oxygen, $R_4$ is $C_1$–$C_4$alkyl and b is an integer ranging from 0 to 10, or, if Y is OH and a is 2, X is $—CH_2CH_2T_2(CH_2CH_2O)_bCH_2CH_2—$, in which b is as defined above, or furthermore X is $—C_cH_{2c}—$,

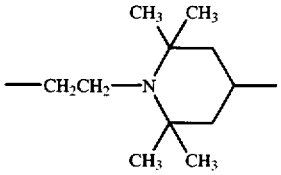

or $—CH_2—CH=CH—CH_2—$, in which $T_2$ is oxygen, sulfur or

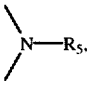

$R_5$ is hydrogen, b is the number 0 or 1 and c is an integer ranging from 2 to 8, or, if a is 3, X is

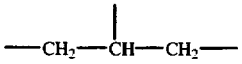

or $N(CH_2CH_2—)_3$, or, if Y is OH and a is 4,

X is

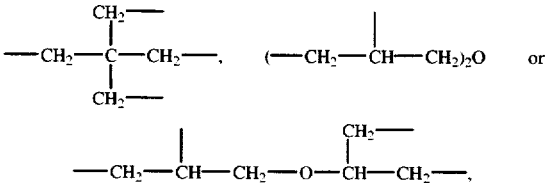

or, if Y is OH and a is 6,

X is

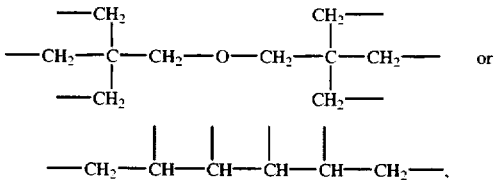

or, if Y is $—HNR_1$ and a is 1,

X is $C_1$–$C_{10}$alkyl, $C_3$–$C_{18}$alkenyl, $C_5$–$C_7$cycloalkyl or

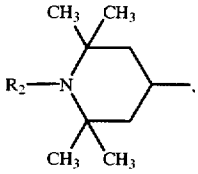

where $R_2$ is as defined above, or, if Y is $—HNR_1$ and a is 2,

X is $—C_fH_{2f}—$ in which f is an integer ranging from 2 to 10 and, in the compound of the formula II, the radicals Z are hydrogen or a group of the formula

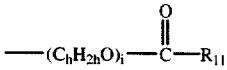

and k is 1, 2 or 3, h is 2 or 3, i is an integer ranging from 0 to 4 and $R_{11}$ is $C_1$–$C_{20}$alkyl or $C_8$–$C_{20}$alkenyl, with the proviso that the compound of the formula II comprises a group

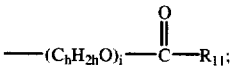

in the compound of the formula III, $R_{12}$ is $C_1$–$C_6$alkyl or $C_5$–$C_7$cycloalkyl, $R_{15}$ is hydrogen, $C_1$–$C_6$alkyl or $C_5$–$C_7$cycloalkyl, s is 1 or 2, Q is $—C_mH_{2m}—$ or

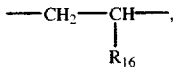

m is an integer ranging from 0 to 3, $R_{16}$ is $C_1$–$C_4$alkyl and n is an integer ranging from 1 to 6, where, if n is 1, $R_{17}$ is hydrogen, $C_1$–$C_{18}$alkyl, $C_5$–$C_7$cycloalkyl, $C_2$–$C_{18}$alkenyl, a monovalent radical of a hexose, a monovalent radical of a hexitol,

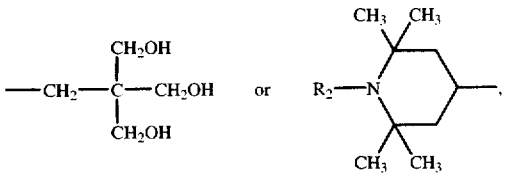

in which $R_2$ is as defined above, or furthermore $R_{17}$ is

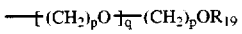

in which $R_{19}$ is hydrogen, $C_1$–$C_{18}$alkyl or $C_5$–$C_7$cycloalkyl, in which p is an integer ranging from 2 to 4, q is an integer ranging from 2 to 10, or, if n is 2, $R_{17}$ is a divalent radical of a hexose, a divalent radical of a hexitol,

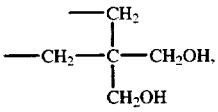

$—C_rH_{2r}—$,

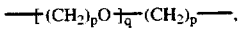

in which p and q are as defined above, $—CH_2CH_2—T_4—CH_2CH_2—$, or

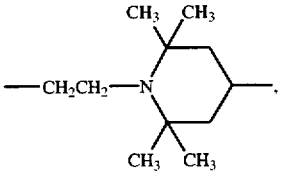

in which r is an integer ranging from 2 to 10, $T_4$ is sulfur or

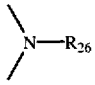

and $R_{26}$ is hydrogen, $C_1$–$C_{10}$alkyl or $C_5$–$C_8$cycloalkyl, or, if n is 3, $R_{17}$ is a trivalent radical of a hexose, a trivalent radical of a hexitol,

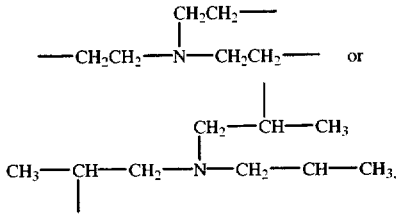

or, if n is 4, $R_{17}$ is a tetravalent radical of a hexose, a tetravalent radical of a hexitol,

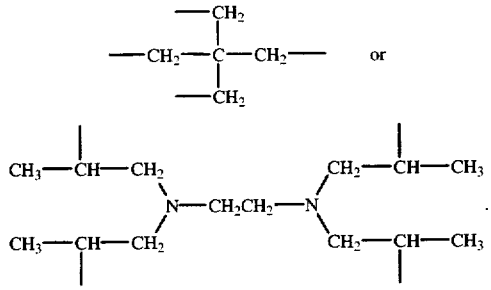

5. A process according to claim 1, in which in the compound of the formula I, the radicals Y independently of one another are hydroxyl or $—NH_2$ and a is an integer ranging from 1 to 4, where, if a is 1, X is

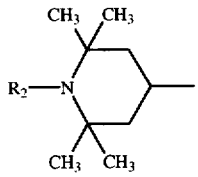

and $R_2$ is hydrogen, methyl or $HOCH_2CH_2—$, or, if Y is OH and a is 2,

X is $—CH_2CH_2T_2(CH_2CH_2O)_bCH_2CH_2—$, $—C_cH_{2c}—$ or

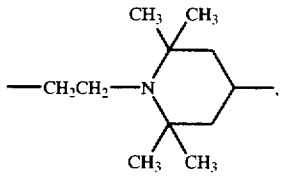

in which $T_2$ is oxygen, sulfur or

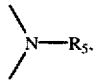

$R_5$ is hydrogen, b is the number 0 or 1 and c is the number 2, 3 or 4, or, if Y is OH and a is 3, X is

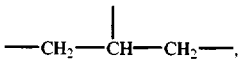

or, if Y is OH and a is 4,

X is

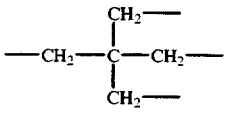

and, in the compound of the formula II, the radicals Z are hydrogen or a group of the formula

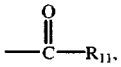

k is the number 1 and $R_{11}$ is $C_1$–$C_{20}$alkyl or $C_8$–$C_{20}$alkenyl, with the proviso that the compound of the formula II comprises a group

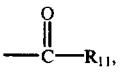

and, in the compound of the formula III, $R_{12}$ is tert-butyl, $R_{15}$ is $C_1$–$C_4$alkyl and is bonded in the ortho-position relative to the OH group, s is the number 1, Q is $—C_mH_{2m}—$ and is bonded in the para-position relative to the OH group, where, m is the number 2, n is 1 and $R_{17}$ is $C_1$–$C_4$alkyl.

6. A process according to claim 1, in which in the compound of the formula III, $R_{12}$ is $C_1$–$C_4$alkyl or cyclohexyl, $R_{15}$ is $C_1$–$C_4$alkyl or cyclohexyl and is bonded in the ortho-position relative to the OH group, s is the number 1, Q is $—C_mH_{2m}—$ and is bonded in the para-position relative to the OH group, where m is an integer ranging from 0 to 3 and n is an integer ranging from 1 to 4, where, if n is 1, $R_{17}$ is hydrogen, $C_1$–$C_{10}$alkyl, cyclohexyl, $C_2$–$C_{18}$alkenyl or

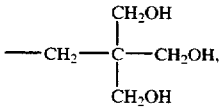

or, if n is 2, $R_{17}$ is

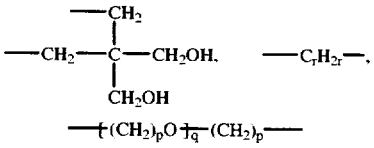

or $—CH_2CH_2—T_4—CH_2CH_2—$ in which p is an integer ranging from 2 to 4, q is an integer ranging from 2 to 10, r is an integer ranging from 2 to 6, $T_4$ is sulfur or

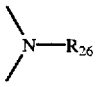

and $R_{26}$ is hydrogen or $C_1$–$C_4$alkyl, or, if n is 3, $R_{17}$ is

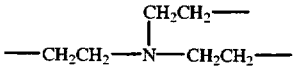

or

-continued

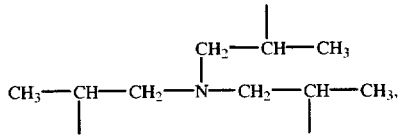

or, if n is 4, $R_{17}$ is

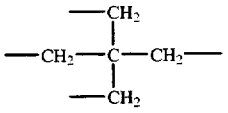

or

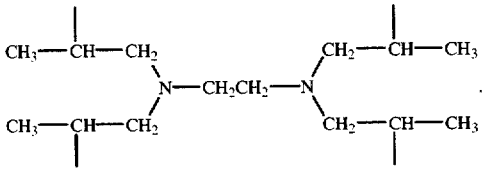

7. A process according to claim 1, in which, in the compound of the formula III, $R_{12}$ is tert-butyl, $R_{15}$ is $C_1$–$C_4$alkyl and is bonded in the ortho-position relative to the OH group, s is the number 1, Q is $—C_mH_{2m}—$ and is bonded in the para-position relative to the OH group, in which m is the number 2 and n is an integer 1, 2 or 4, where, if n is 1, $R_{17}$ is $C_1$–$C_4$alkyl, or, if n is 2, $R_{17}$ is

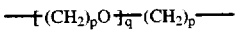

or $—CH_2CH_2—T_4—CH_2CH_2—$, in which p is the number 2, q is the number 2 and $T_4$ is sulfur, or, if n is 4, $R_{17}$ is

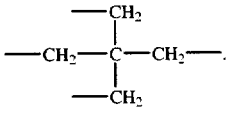

8. A process according to claim 1, in which the compound of the formula I is pentaerythritol, thiodiethylene glycol, 1,4-butanediol, 1,2-propanediol, diethylene glycol, triethylene glycol, diethanolamine, glycerol,

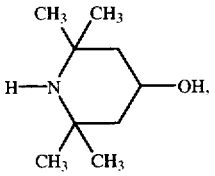

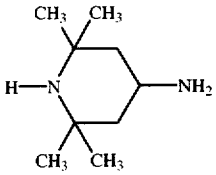

or

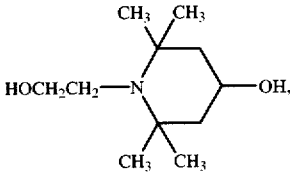

the compound of the formula II is sunflower oil, coconut fat, rapeseed oil, maize germ oil, safflower oil, olive oil, groundnut oil or Radiamuls, and the compound of the formula III is methyl 3-(3',5'-di-tert-butyl-4'-hydroxyphenyl)propionate or methyl 3-(3'-tert-butyl-4'-hydroxy-5'-methylphenyl)propionate.

9. A process according to claim 1, in which the molar quantitative ratio of components a), b) and c) is 0.1:1:0.1 to 15:1:30.

10. A process according to claim 1, in which the amount by weight of active group E-2

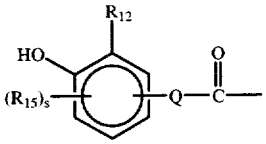

(E-2) in component (β) is 30 to 80% by weight.

11. A process according to claim 1, in which first components a) and b) are reacted with each other and the resulting intermediate is subsequently reacted with component c).

12. A process according to claim 1, in which the fuel is a fuel which contains less than 0.10% by weight of sulfur.

13. A process according to claim 1, wherein the fuel contains 0.0001 to 10% by weight, based on the weight of the fuel, of the product obtainable according to claim 1.

* * * * *